US010797442B2

(12) United States Patent
Tsai

(10) Patent No.: US 10,797,442 B2
(45) Date of Patent: Oct. 6, 2020

(54) BIDIRECTIONAL DOUBLE-SIDED ELECTRICAL CONNECTOR

(71) Applicant: Chou Hsien Tsai, New Taipei (TW)

(72) Inventor: Chou Hsien Tsai, New Taipei (TW)

( * ) Notice: Subject to any disclaimer, the term of this patent is extended or adjusted under 35 U.S.C. 154(b) by 124 days.

(21) Appl. No.: 15/735,236

(22) PCT Filed: Jun. 12, 2016

(86) PCT No.: PCT/CN2016/085455
§ 371 (c)(1),
(2) Date: Dec. 11, 2017

(87) PCT Pub. No.: WO2016/197977
PCT Pub. Date: Dec. 15, 2016

(65) Prior Publication Data

US 2018/0183184 A1 Jun. 28, 2018

Related U.S. Application Data

(60) Provisional application No. 62/174,011, filed on Jun. 11, 2015.

(51) Int. Cl.

| | |
|---|---|
| ***H01R 13/631*** | (2006.01) |
| ***H01R 13/642*** | (2006.01) |
| ***H01R 24/60*** | (2011.01) |
| ***H01R 27/00*** | (2006.01) |
| ***H01R 29/00*** | (2006.01) |
| ***H01R 12/91*** | (2011.01) |
| ***H01R 13/26*** | (2006.01) |

(Continued)

(52) U.S. Cl.
CPC ..... *H01R 13/642* (2013.01); *H01R 12/91* (2013.01); *H01R 13/26* (2013.01); *H01R 13/5025* (2013.01); *H01R 13/631* (2013.01); *H01R 13/6315* (2013.01); *H01R 24/60* (2013.01); *H01R 27/00* (2013.01); *H01R 29/00* (2013.01); *H01R 43/16* (2013.01); *H01R 43/18* (2013.01); *H01R 13/405* (2013.01)

(58) Field of Classification Search
CPC ..... H01R 29/00; H01R 24/60; H01R 13/5025
See application file for complete search history.

(56) References Cited

U.S. PATENT DOCUMENTS

| | | | | |
|---|---|---|---|---|
| 7,862,345 | B2 * | 1/2011 | Fukazawa | H01R 12/716 439/74 |
| 8,376,766 | B1 * | 2/2013 | Huettner | H01R 12/91 439/248 |
| 9,178,310 | B2 * | 11/2015 | Tsai | H01R 13/6315 |

FOREIGN PATENT DOCUMENTS

| | | |
|---|---|---|
| CN | 202111346 | 1/2012 |
| CN | 204376019 | 6/2015 |

(Continued)

*Primary Examiner* — Felix O Figueroa
(74) *Attorney, Agent, or Firm* — WPAT, PC

(57) ABSTRACT

A bidirectional double-sided electrical connector includes a tongue and two rows of elastically movable connection points disposed on top and bottom sides of the tongue, wherein the tongue and the elastically movable connection points can respectively act independently. Two rows of contact terminals provide the two rows of elastically movable connection points and are positioned on an insulation seat. The tongue is vertically and floatingly movable relative to the insulation seat. The elastically movable connection points are respectively floatingly disposed on, lie on or are embedded with the top and bottom sides of the tongue.

5 Claims, 21 Drawing Sheets

(51) Int. Cl.

| | |
|---|---|
| ***H01R 13/502*** | (2006.01) |
| ***H01R 43/16*** | (2006.01) |
| ***H01R 43/18*** | (2006.01) |
| *H01R 13/405* | (2006.01) |

(56) References Cited

FOREIGN PATENT DOCUMENTS

| | | |
|---|---|---|
| TW | M474279 | 3/2014 |
| TW | M501663 | 5/2015 |

* cited by examiner

BIDIRECTIONAL DOUBLE-SIDED ELECTRICAL CONNECTOR

CROSS-REFERENCE TO RELATED APPLICATIONS

This application is a national stage application of PCT Patent Application No. PCT/CN2016/085455, filed on Jun. 12, 2016, which claims priority to U.S. Provisional Application No. 62/174,011, filed on Jun. 11, 2015, the content of which is incorporated herein by reference.

BACKGROUND OF THE INVENTION

Field of the Invention

The invention relates to the filed of a bidirectional double-sided electrical connector, and more particularly to a bidirectional double-sided electrical connector capable of docking with a complementary electrical connector to perform the transmission.

Description of the Related Art

At present, due to the increasingly powerful functions of various electronic products and the increasing popularity of handheld devices, there is an increasing demand for signal transmission among various products or devices, wherein signal transmission between the devices is performed through signal interfaces. The signal interface is, for example, an electrical connector or a complementary electrical connector docking therewith, wherein the electrical connector is an electrical receptacle, and the complementary electrical connector is an electrical plug.

Before the electrical plug and the electrical receptacle are docked together, it is necessary to make the electrical plug be directed toward the electrical receptacle in the correct direction. That is, the electrical receptacle has the insertion directionality, which is the so-called mistake-proof function. This function is to ensure that the connection interface of the electrical plug can contact the contact terminals on the electrical receptacle. However, most users do not have the habit of electrically connecting plugs to electrical receptacles in the correct direction, and the mistake-proof function causes the docking failure between the electrical plug and the electrical receptacle. Then, the user flips the electrical connector to perform the correct docking. In other words, the mistake-proof function causes the user's problems on the contrary.

Thus, on the market is provided with a bidirectional double-sided electrical connector, which has the double-sided docking function and two sets of contact terminals to eliminate the insertion directionality of the bidirectional double-sided electrical connector. The user can dock the bidirectional double-sided electrical connector with the complementary electrical connector in either direction. However, the existing bidirectional double-sided electrical connector has the high manufacturing cost, and the low functional reliability. Based on this, how to make the bidirectional double-sided electrical connector have the stable reliability and the low cost has become the industry's goal to be reached.

BRIEF SUMMARY OF THE INVENTION

In view of the drawback of the prior art, an objective of the invention is to provides a bidirectional double-sided electrical connector having a floating tongue, wherein the top and bottom sides of the floating tongue provide top and bottom connection interfaces capable of docking with a complementary electrical connector to facilitate the use of the user.

One of the objectives of the invention is to provide a bidirectional double-sided electrical connector, wherein the tongue thereof has different thicknesses or protrusion design, and the thickest portion of or the position with the protrusion the tongue can ensure the short-circuit problem upon docking to prevent the terminal interface from contacting the metal shell body of the complementary electrical connector.

One of the objectives of the invention is to provide a bidirectional double-sided electrical connector, wherein the tongue and the terminal interface thereof respectively act independently to ensure the contact conduction and anti-short-circuit functions.

To achieve the above-mentioned objective, the invention provides a bidirectional double-sided electrical connector, including: an outer housing; an insulation seat; a floating tongue, which is disposed on a front end of the insulation seat, is covered by the outer housing to form a connection slot in the outer housing, and is vertically movably disposed in a middle section of the connection slot in a floating manner; and two connection interfaces respectively disposed on top and bottom sides of the floating tongue, wherein each of the connection interfaces includes multiple elastically movable connection points provided by one row of contact terminals, one of the contact terminals of each of the rows of contact terminals has one of the elastically movable connection points, an elastically movable extension, a fixing portion and a pin, the elastically movable connection point is disposed on a front end of the elastically movable extension, the elastically movable extension and the pin are respectively disposed on a front end and a rear end of the fixing portion, the elastically movable connection points of the two rows of contact terminals are respectively floatingly disposed or lie on the top and bottom sides of the floating tongue, and the pins of the two rows of contact terminals extend out of the insulation seat.

The invention further provides a bidirectional double-sided electrical connector, including: an outer housing; an insulation seat; a floating tongue, which is disposed on a front end of the insulation seat, is covered by the outer housing to form a connection slot in the outer housing and is vertically movably disposed in a middle section of the connection slot in a floating manner, wherein a top plate surface and a bottom plate surface of the floating tongue are exposed to the connection slot, and each of top and bottom sides of the floating tongue includes an elastically-movable-connection-point movement region; and two connection interfaces respectively disposed on the top and bottom sides of the floating tongue, wherein each of the connection interfaces includes multiple elastically movable connection points provided by one row of contact terminals, one of the contact terminals of each of the rows of contact terminals has one of the elastically movable connection points, an elastically movable extension, a fixing portion and a pin, the elastically movable connection point is disposed on a front end of the elastically movable extension, the elastically movable extension and the pin are respectively disposed on a front end and a rear end of the fixing portion, and the pins of the two rows of contact terminals extend out of the insulation seat; wherein the elastically movable connection points of the two rows of contact terminals are respectively depressedly disposed in the two elastically-movable-connection-point movement regions of the floating tongue, and the elastically movable connection points are not higher than the top plate surface and the bottom plate surface of the floating tongue.

The invention further provides a bidirectional double-sided electrical connector, including: an outer housing; an insulation seat; a floating tongue, which is disposed on a front end of the insulation seat, is covered by the outer housing to form a connection slot in the outer housing, and is vertically movably disposed in a middle section of the connection slot in a floating manner; and two connection interfaces respectively disposed on top and bottom sides of the floating tongue, wherein each of the two connection interfaces includes multiple elastically movable connection points provided by one row of contact terminals, one of the contact terminals of each of the rows of contact terminals has one of the elastically movable connection points, an elastically movable extension, a fixing portion and a pin, the elastically movable connection point is disposed on a front end of the elastically movable extension, the elastically movable extension and the pin are respectively disposed on a front end and a rear end of the fixing portion, the elastically movable connection points of the two rows of contact terminals are respectively disposed on the top and bottom sides of the floating tongue, and the pins of the two rows of contact terminals extend out of the insulation seat, wherein the floating tongue and the elastically movable connection points respectively act independently.

The invention further provides a bidirectional double-sided electrical connector, including: an outer housing; an insulation seat; a floating tongue, which is disposed on a front end of the insulation seat, is covered by the outer housing to form a connection slot in the outer housing, and is vertically movably disposed in a middle section of the connection slot in a floating manner; and two connection interfaces respectively disposed on top and bottom sides of the floating tongue, wherein each of the two connection interfaces includes multiple elastically movable connection points provided by one row of contact terminals, one of the contact terminals of each of the rows of contact terminals has one of the elastically movable connection points, an elastically movable extension, a fixing portion and a pin, the elastically movable connection point is disposed on a front end of the elastically movable extension, and the elastically movable extension and the pin are respectively disposed on a front end and a rear end of the fixing portion, wherein the elastically movable connection points of the two rows of contact terminals are respectively floatingly disposed or lie on the top and bottom sides of the floating tongue, the fixing portions of the two rows of contact terminals are positioned in the insulation seat, and the pins of the two rows of contact terminals extend out of the insulation seat.

The invention further provides a bidirectional double-sided electrical connector, including: an outer housing; an insulation seat; a floating tongue, which is disposed on a front end of the insulation seat, is covered by the outer housing to form a connection slot in the outer housing, and is vertically movably disposed in a middle section of the connection slot in a floating manner; two connection interfaces respectively disposed on top and bottom sides of the floating tongue, wherein each of the two connection interfaces includes multiple elastically movable connection points provided by one row of contact terminals, one of the contact terminals of each of the rows of contact terminals has one of the elastically movable connection points, an elastically movable extension, a fixing portion and a pin, the elastically movable connection point is disposed on a front end of the elastically movable extension, the elastically movable extension and the pin are respectively disposed on a front end and a rear end of the fixing portion, the elastically movable connection points of the two rows of contact terminals are respectively disposed on the top and bottom sides of the floating tongue, and the pins of the two rows of contact terminals extend out of the insulation seat; and at least two elastic metal sheets connected to the floating tongue, wherein the multiple elastic metal sheets are positioned on two outer sides of one of the rows of contact terminals or in multiple gaps between the multiple contact terminals.

The invention further provides a bidirectional double-sided electrical connector, including: an outer housing; an insulation seat; a floating tongue, which is disposed on a front end of the insulation seat, is covered by the outer housing to form a connection slot in the outer housing, and is vertically movably disposed in a middle section of the connection slot in a floating manner; and two connection interfaces respectively disposed on top and bottom sides of the floating tongue, wherein each of the two connection interfaces includes multiple elastically movable connection points provided by one row of contact terminals, one of the contact terminals of each of the rows of contact terminals has one of the elastically movable connection points, an elastically movable extension, a fixing portion and a pin, the elastically movable connection point is disposed on a front end of the elastically movable extension and has a bevel guide, the elastically movable extension and the pin are respectively disposed on a front end and a rear end of the fixing portion, and the pins of the two rows of contact terminals extend out of the insulation seat, wherein the elastically movable connection points of the two rows of contact terminals are respectively disposed on the top and bottom sides of the floating tongue and have a vertically overlapped positional relationship, and the two bevel guides of the two elastically movable connection points with the vertically overlapped positional relationship are staggered in a left-to-right direction.

The invention further provides a bidirectional double-sided electrical connector, including: an outer housing; an insulation seat; a floating tongue, which is disposed on a front end of the insulation seat, is covered by the outer housing to form a connection slot in the outer housing, and is vertically movably disposed in a middle section of the connection slot in a floating manner, wherein top and bottom sides of the floating tongue are respectively provided with multiple elastic-movement terminal slots; and two connection interfaces respectively disposed on the top and bottom sides of the floating tongue, wherein each of the two connection interfaces are multiple elastically movable connection points provided by one row of contact terminals, one of the contact terminals of each of the rows of contact terminals has one of the elastically movable connection points, an elastically movable extension, a fixing portion and a pin, the elastically movable connection point is disposed on a front end of the elastically movable extension, the elastically movable extension and the pin are respectively disposed on a front end and a rear end of the fixing portion, the elastically movable connection points of the two rows of contact terminals are respectively disposed on the top and bottom sides of the floating tongue, and the pins of the two rows of contact terminals extend out of the insulation seat, wherein one of the elastic-movement terminal slots stores one of the elastically movable connection points, or further includes the elastic-movement terminal slot having multiple through slots separated by a separation column or the elastic-movement terminal slots have multiple insulation baffles separating the two rows of elastically movable connection points.

The invention further provides a bidirectional double-sided electrical connector, including: an outer housing; an insulation seat; a floating tongue, which is disposed on a front end of the insulation seat, is covered by the outer housing to form a connection slot in the outer housing, and is vertically movably disposed in a middle section of the connection slot in a floating manner; and two connection interfaces respectively disposed on top and bottom sides of the floating tongue, wherein each of the two connection interfaces includes multiple elastically movable connection points provided by one row of contact terminals, one of the contact terminals of each of the rows of contact terminals has one of the elastically movable connection points, an elastically movable extension, a fixing portion and a pin, the elastically movable connection point is disposed on a front end of the elastically movable extension, the elastically movable extension and the pin are respectively disposed on a front end and a rear end of the fixing portion, and the elastically movable connection points of the two rows of contact terminals are respectively disposed on the top and bottom sides of the floating tongue, and the pins of the two rows of contact terminals extend out of the insulation seat, wherein a front edge of the insulation seat is provided with at least one middle-section support structure, the middle-section support structure and one of the elastically movable extensions have a vertically overlapped positional relationship, or one of the elastically movable extensions has a middle section support segment exposed outside the insulation seat, or one of the elastically movable extensions has a middle section support segment exposed outside the insulation seat and has a vertically overlapped positional relationship together with a middle-section support structure of a front edge of the insulation seat.

The invention further provides a bidirectional double-sided electrical connector, including: an outer housing; an insulation seat; a floating tongue, which is disposed on a front end of the insulation seat, is covered by the outer housing to form a connection slot in the outer housing, and is vertically movably disposed in a middle section of the connection slot in a floating manner, wherein the floating tongue includes a water drop type structure or a plate body having a thicker front section and a rear section with a gradually reduced structure; and two connection interfaces respectively disposed on top and bottom sides of the floating tongue, wherein each of the two connection interfaces includes multiple elastically movable connection points provided by one row of contact terminals, one of the contact terminals of each of the rows of contact terminals has one of the elastically movable connection points, an elastically movable extension, a fixing portion and a pin, the elastically movable connection point is disposed on a front end of the elastically movable extension, and the elastically movable extension and the pin are respectively disposed on a front end and a rear end of the fixing portion, and the pins of the two rows of contact terminals extend out of the insulation seat, wherein the elastically movable connection points of the two rows of contact terminals are respectively floatingly disposed or lie on the top and bottom sides of the floating tongue, and is disposed on the plate body nearer to the water drop type structure or the front section.

The invention further provides an electrical receptacle including the bidirectional double-sided electrical connector, wherein the two connection interfaces satisfy USB A type 2.0 specification, USB A type 3.0 specification or USB A type 3.1 specification, and the two rows of pins extend out of the insulation seat in an arrangement of one single row, staggered front and rear rows, or overlapped front and rear rows.

The invention further provides an electrical receptacle including the bidirectional double-sided electrical connector, wherein the multiple fixing portions are embedded into or assembled and positioned in the insulation seat.

The invention further provides an electrical receptacle including the bidirectional double-sided electrical connector, wherein a hollow region is present between the floating tongue and the insulation seat, and the multiple elastically movable extensions of the two rows of contact terminals are disposed in the hollow region.

The invention further provides an electrical receptacle including the bidirectional double-sided electrical connector, wherein a distance between a front end of the floating tongue and an insertion port of the connection slot is greater than a standard specification of a USB 2.0 A Type socket of USB Association.

The invention further provides an electrical receptacle including the bidirectional double-sided electrical connector, wherein the two rows of contact terminals are reversely arranged according to circuit serial numbers, and the circuit serial numbers include power, signal D+, signal D− and ground.

The invention further provides an electrical receptacle including the bidirectional double-sided electrical connector, and further including two rows of flat contact terminals disposed on the top and bottom sides of the floating tongue and satisfying USB A type 3.0 specification or USB A type 3.1 specification, wherein the two connection interfaces satisfy USB A type 2.0 specification, multiple fixed connection points of the two rows of flat contact terminals are fixed to and exposed from top and bottom surfaces of the floating tongue, the two rows of flat contact terminals are connected to the floating tongue and the insulation seat, the floating tongue and the insulation seat are separated from each other, and extensions of the two rows of flat contact terminals disposed between the floating tongue and the insulation seat are elastically movable extensions.

The invention further provides an electrical plug including the bidirectional double-sided electrical connector, and further including two rows of flat contact terminals disposed on the top and bottom sides of the floating tongue and satisfying USB A type 3.0 specification or USB A type 3.1 specification, wherein the two connection interfaces satisfy USB A type 2.0 specification, the two rows of flat contact terminals are connected to the floating tongue and the insulation seat, the floating tongue and the insulation seat are separated from each other, and extensions of the two rows of flat contact terminals disposed between the floating tongue and the insulation seat are elastically movable extensions.

The invention further provides a bidirectional USB 3.0 contact interface electrical connector, including: an insulation seat; and a floating tongue, which is disposed on a front end of the insulation seat, is covered by an outer housing to form a connection slot, and is vertically movably and floatingly disposed in a middle section of the connection slot, wherein each of top and bottom sides of the floating tongue is provided with one row of flat-contacting contact terminal connection interfaces capable of dual-positionally and bidirectionally docking and positioning with an electrical connector, upper and lower rows of flat-contacting contact terminals of front and rear sides of the floating tongue and the floating tongue are injected, embedded and molded together, and each of the upper and lower rows of flat-contacting contact terminals have five flat-contacting contacts, a ground terminal at a middle, two pairs of signal terminals on two sides, and four elastically movable contacts disposed behind the flat-contacting contacts to form a USB 3.0 contact interface.

The invention further provides a bidirectional USB 3.0 contact interface electrical connector, including: an insulation seat; and a floating tongue, which is disposed on a front end of the insulation seat, is covered by an outer housing to form a connection slot, and is vertically movably and floatingly disposed in a middle section of the connection slot, wherein each of top and bottom sides of the floating tongue is provided with one row of flat-contacting contact terminal connection interfaces capable of dual-positionally and bidirectionally docking and positioning with an electrical connector, wherein each of the upper and lower rows of flat-contacting contact terminals has five flat-contacting contacts, a ground terminal at a middle, two pairs of signal terminals on two sides, and four elastically movable contacts disposed behind the flat-contacting contacts to form a USB 3.0 contact interface, the signal terminals on the two sides of the upper and lower rows of flat-contacting contact terminals are turned and adjacently embedded with a transversal separation column structure between the flat-contacting contacts of the floating tongue and the elastically movable contacts.

The invention further provides a method of manufacturing the two rows of contact terminals of the bidirectional double-sided electrical connector, including respectively cutting out two metal sheets into the two rows of contact terminals, or cutting out one single metal sheet into the two rows of contact terminals.

The invention further provides the bidirectional double-sided electrical connector, wherein: (a) two elastically movable contact interfaces are the same, are disposed vertically and are aligned with each other; (b) the elastically movable connection points on the top and bottom sides of the floating tongue are floatingly disposed or lie on or depressedly disposed on the floating tongue; (c) the fixing portions of the two rows of contact terminals are embedded or assembled and positioned with the insulation seat; (d) the bidirectional double-sided electrical connector is a USB A TYPE socket, widths of the contacts and the extensions of top and bottom signal contact terminals of the socket are smaller than widths of the ground terminal and the power contact terminals; (e) further including a docking electrical connector, wherein the docking electrical connector is provided with a connection plate, at least one surface of the connection plate is provided with at least one row of contact terminal connection interfaces, and when the one docking electrical connector is docked and inserted, the connection plate of the docking electrical connector pushes the floating tongue floatingly disposed in the middle section of the connection slot to offset vertically, so that the elastically movable connection point floatingly disposed on one of the top and bottom sides of the floating tongue is exposed and projects from the relatively offset one surface of the floating tongue to present a projecting height difference of the elastically movable connection point, and the projecting elastically movable connection points resilience rest against and are electrically connected to the docking inserted connection interface; (f) further including a docking electrical connector, wherein the docking electrical connector is provided with a connection plate, at least one surface of the connection plate is provided with at least one row of contact terminal connection interfaces, and when the one docking electrical connector is docked and inserted, the connection plate of the docking electrical connector pushes the floating tongue floatingly disposed in the middle section of the connection slot to offset vertically, so that the elastically movable connection point floatingly disposed on one of the top and bottom sides of the floating tongue is depressed in the relatively offset one surface of the floating tongue to present a depressed height difference of the elastically movable connection point, and a metal shell of a connection slot of the docking electrical connector and the elastically movable connection point depressed from one surface of the floating tongue hold a safety clearance without contacting each other; (g) the floating tongue is provided with multiple elastic-movement terminal slots, each of the elastic-movement terminal slots corresponds to one of upper contact terminals and one of lower contact terminals, the elastic-movement terminal slot partially stores the corresponding upper contact terminal and lower contact terminal therein, and the upper contact terminals and the lower contact terminals are restricted to swing only in a vertical direction; (h) the floating tongue and base seat are separated from each other, and the empty portion is provided with multiple elastic metal sheets being multiple elastic movable portions; (i) the front section of the insulation seat is integrally provided with an insulation middle-section support structure resting against the top and bottom extending elastic movable portions; (j) the upper and lower rows of elastically movable contacts are not higher than top and bottom plate surfaces of the floating tongue; (k) two sides of the floating tongue are provided with top and bottom elastic movable connection points relatively overlapped, two bevel guides of the top and bottom elastic movable connection points are staggered in a left-to-right direction to present left and right staggered structures; (l) two bevel guides of the top and bottom elastic movable connection points are staggered in a left-right direction, and elastic movement regions of the floating tongue on two bevel guides of the top and bottom elastic movable connection points are provided with multiple through slots or multiple partition plate structures; (m) width of the extensions of the top and bottom rows D+ and D− contact terminals are smaller than widths of the ground terminal and the power contact terminal; (n) top and bottom surfaces of the floating tongue are provided with water-drop arrow type anti-short-circuit insulation structures; (o) the bidirectional double-sided connector is an A TYPE USB 2.0/3.0/3.1 contact interface socket; (p) the bidirectional double-sided connector is an A TYPE USB 2.0/3.0/3.1 contact interface socket, and an elastically movable extension of the top and bottom pairs of signal terminals is disposed in an empty area between the floating tongue and the insulation seat; (q) the extensions of the flat-contacting high differential terminal set of the upper and lower rows of contact terminals are adjacently arranged and embedded into the insulated floating tongue and the base seat; (r) upper and lower rows of USB 3.0 contact interfaces of front and rear sides of the floating tongue are respectively five plane contacts of RX+, RX−, GND, TX+, TX−, and four elastically movable contacts of power, signals D+, D− and ground; (s) upper and lower rows of flat-contacting contact terminals of front and rear sides of the floating tongue and the insulation tongue are one-time embedded together, and front and rear sides of top and bottom surfaces of the floating tongue are provided with transversal separation column structures between five flat-contacting contacts and four elastically movable contacts of the tongue; (t) upper and lower rows of flat-contacting contact terminals of front and rear sides of the floating tongue and the insulation tongue are one-time embedded together, and two side signal terminals of the top and bottom surfaces flat-contacting contact terminal are turned and adjacently embedded together at the tongue; (u) the bidirectional double-sided electrical receptacle may be horizontal, side-standing, vertical, multilayer or a structure composed of different connection interfaces stacked together, and may be two rows or only one row of horizontal pins or in front and rear rows, wherein the front row is horizontal insert pins and the rear row is longitudinal insert pins; or (v) the bidirectional double-sided electrical connection plug or socket may be applied to an adapter device including a HUB expander, power bank/charger/mobile power, or mobile disk/U disk/thumb disk/mobile hard disk, or other electronic device.

According to the above-mentioned descriptions, the bidirectional double-sided electrical connector of the invention includes a tongue and two rows of elastically movable connection points disposed on top and bottom sides of the tongue capable of respectively acting independently. Two rows of contact terminals provide the two rows of elastically movable connection points and are positioned on an insulation seat. The tongue is vertically and floatingly movable relative to the insulation seat. The elastically movable connection points are respectively floatingly disposed on, lie on or are embedded with the top and bottom sides of the tongue.

DETAILED DESCRIPTION OF THE INVENTION

Figure 1:
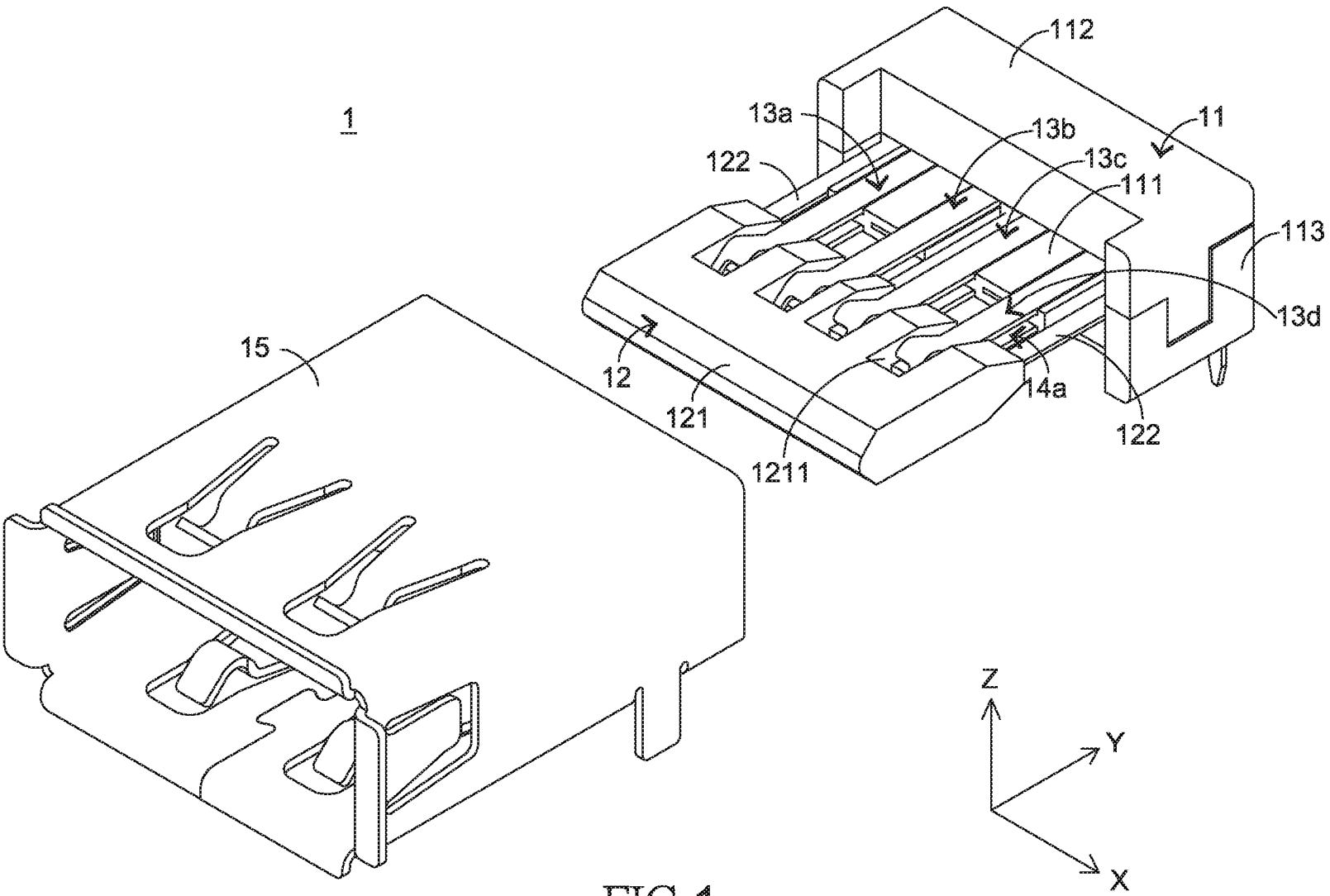
FIG. 1 is a decomposed schematic view showing a partial structure of the bidirectional double-sided electrical connector according to the first preferred embodiment of the invention.

It is to be firstly explained that although the bidirectional double-sided electrical connector of the invention is described by taking the electrical receptacle as an example, the bidirectional double-sided electrical connector is not restricted to the electrical receptacle. Upon application, the bidirectional double-sided electrical connector may be an electrical plug. In this case, the complementary electrical connector docking therewith is an electrical receptacle. That is, when the bidirectional double-sided electrical connector is the electrical receptacle, the complementary electrical connector is the electrical plug. On the contrary, when the bidirectional double-sided electrical connector is the electrical plug, the complementary electrical connector is the electrical receptacle.

The so-called following connection interface of the invention is one surface mainly used to widely contact or approach the complementary electrical connector upon docking, and includes an electroconductive contact structure electrically connected to the complementary electrical connector, and an insulation surface around the electroconductive contact structure. In the example wherein the bidirectional double-sided electrical connector has the tongue, the connection interface may include one plate surface of the tongue, and the docking contact surface, contact section or contact point of the contact terminal abutting upon the plate surface.

Next, for the convenience of explanation, the bidirectional double-sided electrical connector of the invention will be described by based on the X, Y, Z Cartesian coordinate system. From the overall appearance point of view, the bidirectional double-sided electrical connector relatively occupies the larger area on the X-Y plane, wherein the Z axis is perpendicular to the X-Y plane. Also, in the docking process with the complementary electrical connector, the direction parallel to the approaching movements thereof is defined as the Y axis. Thus, from the point of view of the bidirectional double-sided electrical connector of the invention, the following so-called top side and bottom side mainly refer to the surfaces or sides at different Z axis heights relative to the reference body based on the X-Y plane. The following so-called left sides and right sides mainly refer to the positions with different X axis coordinate values on the X-Y plane. The following so-called front end refers to the position interacting with the complementary electrical connector earliest in the docking process with the complementary electrical connector.

FIGS. 1 to 4 are respectively a decomposed schematic view, a schematic top view, a schematically cross-sectional view showing the partial structure and a decomposed schematic view showing the structure in the bidirectional double-sided electrical connector according to the first preferred embodiment of the invention. Referring to FIGS. 1 to 4, the bidirectional double-sided electrical connector 1, such as a USB 2.0 A Type electrical receptacle, includes an insulation seat 11, a floating tongue 12, multiple upper rows of contact terminals 13*a*, 13*b*, 13*c* and 13*d* (13*a* to 13*d*), multiple lower rows of contact terminals 14*a*, 14*b*, 14*c* and 14*d* (14*a* to 14*d*) and an outer housing 15. In the first embodiment, the insulation seat 11 includes an insulation base seat 111, an upper positioning insulation seat 112 and a lower positioning insulation seat 113. The insulation base seat 111 has multiple middle-section support structures 1111 disposed on the top and bottom sides of the insulation base seat 111, wherein only several middle-section support structures 1111 on the side are shown in the drawing. Next, the upper positioning insulation seat 112 and the lower positioning insulation seat 113 can commonly fix partial sections of the upper row of contact terminals 13*a* to 13*d* and partial sections of the lower row of contact terminals 14*a* to 14*d* onto the insulation base seat 111. The floating tongue 12 includes a plate body 121 and multiple resilient members 122, and a hollow region 18 is present between the plate body 121 and the insulation base seat 111. The plate body 121 is disposed on the front end of the insulation base seat 111, and connected to the insulation base seat 111 through the multiple resilient members 122. Next, the top and bottom sides of the plate body 121 have multiple elastic-movement terminal slots 1211 respectively corresponding to the upper row of contact terminals 13*a* to 13*d* and the lower row of contact terminals 14*a* to 14*d*, wherein any one of the elastic-movement terminal slots 1211 can accommodate the partial section of any contact terminal (any one of the upper row of contact terminals 13*a* to 13*d* or any one of the lower row of contact terminals 14*a* to 14*d*) therein.

Referring again to FIGS. 1 to 4, the upper row of contact terminals 13*a* to 13*d* are disposed on one side (top side) of the floating tongue 12. For the convenience of explanation, the upper row of contact terminals 13*a* to 13*d* are assigned with one set of circuit serial numbers. For example, the upper row of contact terminal 13*a* is assigned with the circuit serial number of a, the upper row of contact terminal 13*b* is assigned with the circuit serial number of b, the upper row of contact terminal 13*c* is assigned with the circuit serial number of c, and the upper row of contact terminal 13*d* is assigned with the circuit serial number of d. Next, the upper row of contact terminal 13*a* includes an upper elastic movable connection point 131*a*, an upper elastic movable extension 132*a*, an upper fixing portion 133*a*, an upper pin 134*a* and a positioning structure 135*a* for front-to-rear positioning between the terminals and the plastic, wherein the upper elastic movable connection point 131*a* has an upper bevel guide 1311*a*. The structures of the other upper row of contact terminals 13*b* to 13*d* are also the same as the upper row of contact terminals 13*a* except for the difference that in the first embodiment, the direction of the upper bevel guide 1311*a* is the same as the direction of the upper bevel guide 1311*b* of the upper row of contact terminal 13*b* (biased to the right side when viewed in the direction from the insulation seat 11 of the bidirectional double-sided electrical connector 1 to the floating tongue 12), but is different from the upper bevel guides 1311*c* and 1311*d* of the upper row of the directions of the contact terminals 13*c* and 13*d* (biased to the left side), as shown in FIG. 2.

Similarly, the lower row of contact terminals 14*a* to 14*d* are disposed on the other side of the floating tongue 12, and are assigned with circuit serial numbers. The lower row of contact terminal 14*a* is assigned with the circuit serial number of a, the lower row of contact terminal 14*b* is assigned with the circuit serial number of b, the lower row of contact terminal 14*c* is assigned with the circuit serial number of c, and the lower row of contact terminal 14*d* is assigned with the circuit serial number of d. The lower row of contact terminal 14*a* includes a lower elastic movable connection point 141*a*, a lower elastic movable extension 142*a*, a lower fixing portion 143*a* and a lower pin 144*a*, and the lower elastic movable connection point 141*a* has a lower bevel guide 1411*a*. The structures of the other lower row of contact terminals 14*b* to 14*d* are the same as the lower row of contact terminals 14*a* except for the difference that the direction of the lower bevel guide 1411*a* is the same as the direction of the lower bevel guide 1411*b* of the lower row of contact terminal 14*b*, but is different from the directions of the lower bevel guides 1411*c* and 1411*d* of the lower row of contact terminals 14*c* and 14*d*, as shown in FIG. 2.

Figure 4:
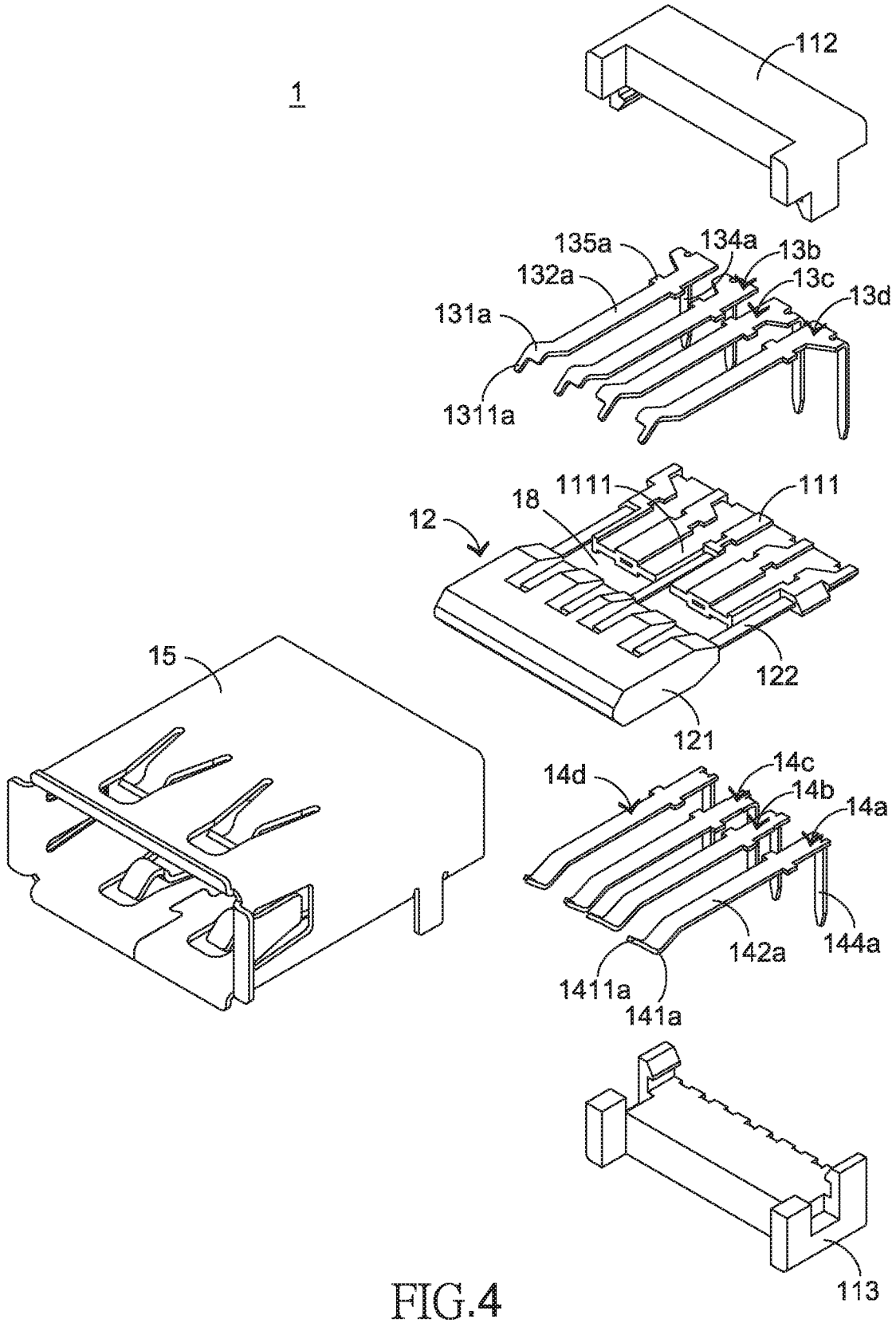
FIG. 4 is a decomposed schematic view showing a structure of the bidirectional double-sided electrical connector according to the first preferred embodiment of the invention.
Figure 5:
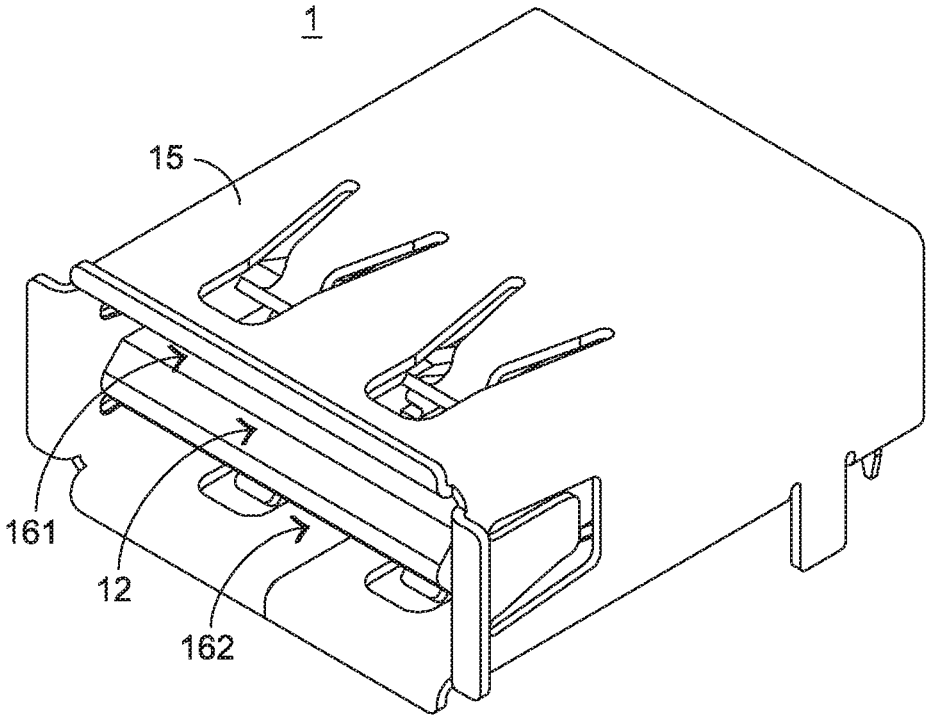
FIG. 5 is a schematic structure view showing the bidirectional double-sided electrical connector according to the first preferred embodiment of the invention at one of various viewing angles.

Referring continuously to FIG. 4, the resilient members 122 may be disposed between the second contact terminal (i.e., the upper row of contact terminal 13*b* or the lower row of contact terminal 14*b*) and the third contact terminal (i.e., the upper row of contact terminal 13*c* or the lower row of contact terminal 14*c*) of two rows of contact terminals. Alternatively, the resilient members 122 may be disposed outside the outermost contact terminal (i.e., the upper row of contact terminals 13*a* and 13*d* or the lower row of contact terminals 14*a* or 14*d*) of two rows of contact terminals. In other words, the multiple resilient members 122 may be disposed at the middle or two outer sides of the floating tongue 12. According to the above-mentioned descriptions, the resilient member 122 of the invention connects the plate body 121 to the front end of the insulation base seat 111, and utilizes the resilience of the resilient member 122 so that the plate body 121 may swing vertically to dock with the complementary electrical connector. So, the position, geometric shape and number of the resilient member 122 are not restricted to those shown in FIG. 4 as long as the resilient swing of the plate body 121 and the operations of the contact terminals may be ensured.

Figure 2:
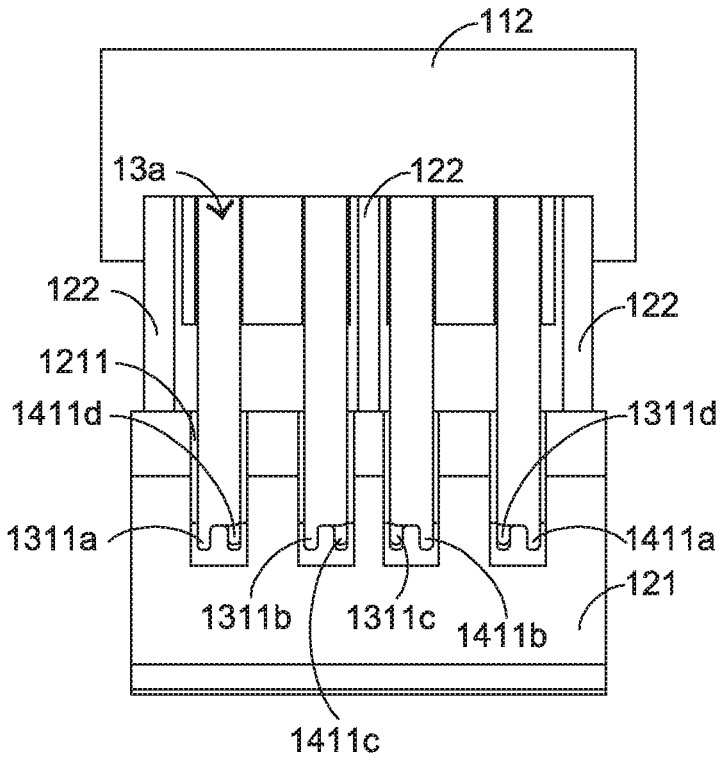
FIG. 2 is a schematic top view showing a partial structure of the bidirectional double-sided electrical connector according to the first preferred embodiment of the invention.

Referring continuously to FIGS. 2 and 4, the partial sections of the multiple resilient members 122 are exposed outside the plate body 121 and the insulation seat 11. Furthermore, because the multiple resilient members 122 have the resilience, the plate body 121 connected to the multiple resilient members 122 is elastically movable to offset vertically. In this preferred embodiment, the multiple resilient members 122 are made of the metal material. The multiple upper elastic movable connection points 131*a* to 131*d*, the multiple upper elastic movable extensions 132*a* to 132*d*, the multiple lower elastic movable connection points 141*a* to 141*d* and the lower elastic movable extensions 142*a* to 142*d* are accommodated within the corresponding elastic-movement terminal slots 1211. Specifically speaking, the upper elastic movable connection point 131*a* and the upper elastic movable extension 132*a* and the lower elastic movable connection point 141*d* and the lower elastic movable extension 142*d* are respectively disposed in the same elastic-movement terminal slot 1211. Similarly, the upper elastic movable connection point 131*b* and the upper elastic movable extension 132*b* and the lower elastic movable connection point 141*c* and the lower elastic movable extension 142*c* are respectively disposed in the same elastic-movement terminal slot 1211, the upper elastic movable connection point 131*c* and the upper elastic movable extension 132*c* and the lower elastic movable connection point 141*b* and the lower elastic movable extension 142*b* are disposed in the same elastic-movement terminal slot 1211, and the upper elastic movable connection point 131*d* and the upper elastic movable extension 132*d* and the lower elastic movable connection point 141*a* and the lower elastic movable extension 142*a* are disposed in the same elastic-movement terminal slot 1211. Next, the directions of the upper bevel guide and the lower bevel guide disposed in the same elastic-movement terminal slot 1211 are different from each other. For example, the directions of the upper bevel guide and the lower bevel guide are mutually interlaced.

The two rows of contact terminals are arranged reversely according to a circuit serial number. The circuit serial number satisfies the USB 2.0 specification of USB Association and includes power, signal D+, signal D− and ground.

Figure 3:
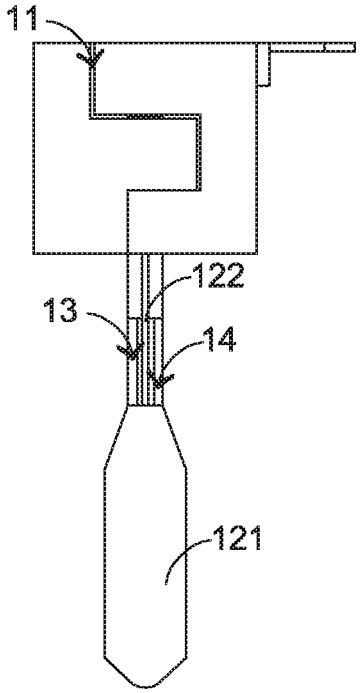
FIG. 3 is a schematically cross-sectional view showing a partial structure of the bidirectional double-sided electrical connector according to the first preferred embodiment of the invention.
Figure 9:
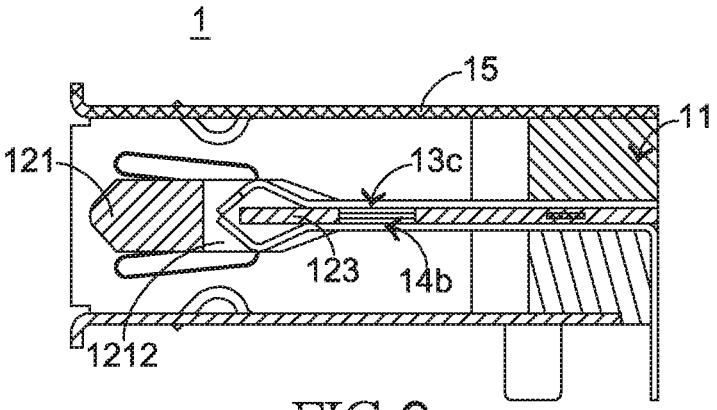
FIG. 9 is a schematically cross-sectional view showing a structure of the bidirectional double-sided electrical connector according to the first preferred embodiment of the invention.

Next, FIG. 9 is a schematically cross-sectional view showing a structure of the first preferred embodiment. Referring to FIGS. 3 and 9, the multiple upper elastic movable connection points 131*a* to 131*d*, multiple upper elastic movable extensions 132*a* to 132*d*, multiple lower elastic movable connection points 141*a* to 141*d* and lower elastic movable extensions 142*a* to 142*d* are accommodated within the corresponding elastic-movement terminal slots 1211. The heights of the multiple upper elastic movable connection points 131*a* to 131*d* are lower than the upper surface of the plate body 121, and the heights of the multiple lower elastic movable connection points 141*a* to 141*d* are higher than the lower surface of the plate body 121. In other words, the multiple upper elastic movable connection points 131*a* to 131*d* and the multiple lower elastic movable connection points 141*a* to 141*d* are stored in the plate body 121.

Furthermore, when viewed from FIG. 4, the upper row of contact terminals 13*b* to 13*d* are arranged in a first order, that is, the upper row of contact terminal 13*a*, the upper row of contact terminal 13*b*, the upper row of contact terminal 13*c* and the upper row of contact terminal 13*d* are arranged in order from right to left of FIG. 4 (when viewed in the direction from the insulation seat 11 of the bidirectional double-sided electrical connector 1 to the floating tongue 12). The lower row of contact terminals 14*a* to 14*d* are arrange din a second order, that is, the lower row of contact terminal 14*d*, the lower row of contact terminal 14*c*, the lower row of contact terminal 14*b* and the lower row of contact terminal 14*a* are arranged in order from right to left of FIG. 4. In short, the contact terminals disposed on the top and bottom sides of the tongue 12 are reversely arranged according to the circuit serial numbers. Furthermore, each of the upper row of contact terminals 13*a* to 13*d* and the lower row of contact terminals 14*a* to 14*d* are made of one single metal material sheet, and two metal material sheets overlap vertically, so that the upper row of contact terminals 13*a* to 13*d* and the lower row of contact terminals 14*a* to 14*d* correspondingly overlap with each other. That is, the upper row of contact terminals 13*a* to 13*d* and the lower row of contact terminals 14*a* to 14*d* are made of two metal material sheets.

Figure 6:
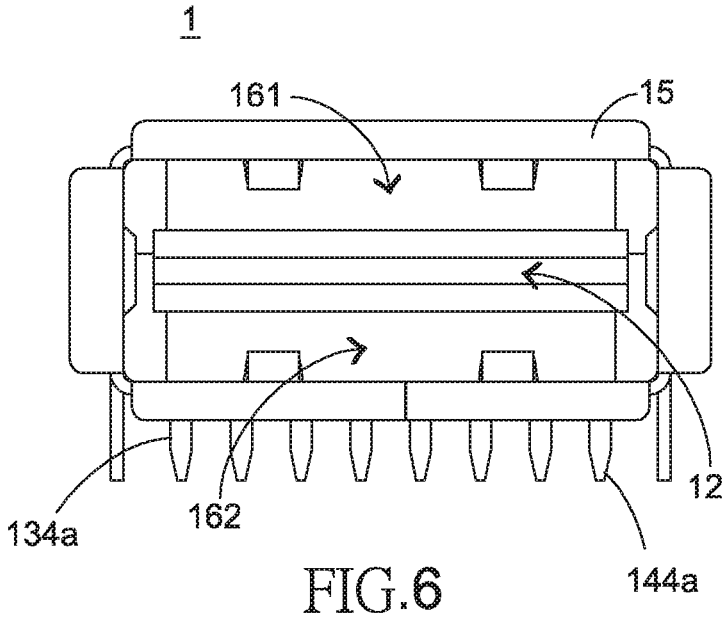
FIG. 6 is a schematic structure view showing the bidirectional double-sided electrical connector according to the first preferred embodiment of the invention at one of various viewing angles.
Figure 7:
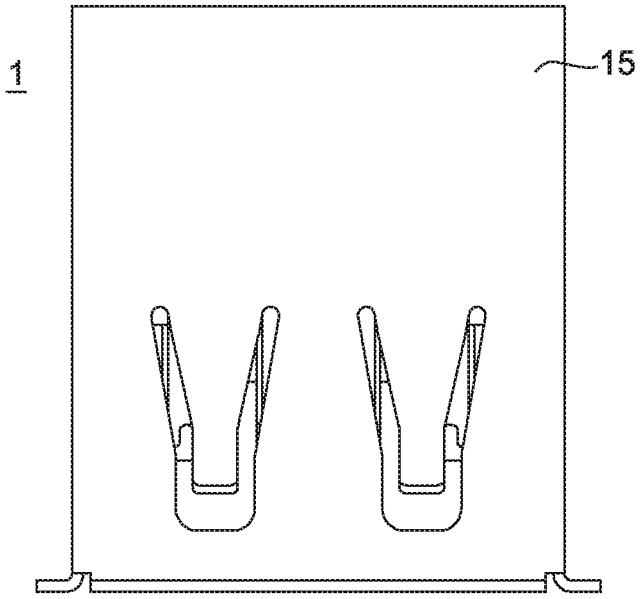
FIG. 7 is a schematic structure view showing the bidirectional double-sided electrical connector according to the first preferred embodiment of the invention at one of various viewing angles.
Figure 8:
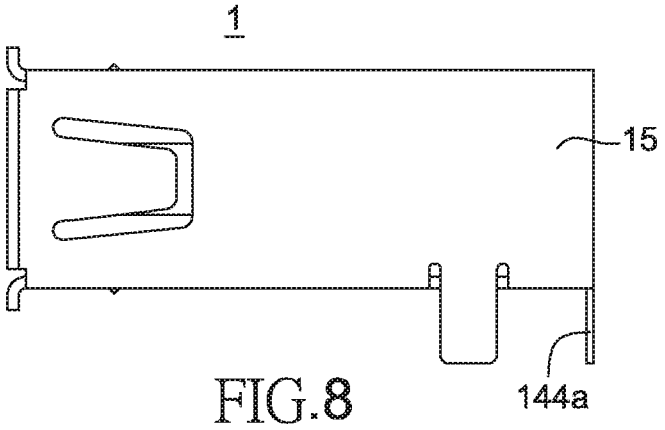
FIG. 8 is a schematic structure view showing the bidirectional double-sided electrical connector according to the first preferred embodiment of the invention at one of various viewing angles.

FIGS. 5 to 8 are schematic structure views showing the first preferred embodiment at various viewing angles. Referring to FIGS. 5 to 8, the bidirectional double-sided electrical connector 1 is assembled in order: the upper row of contact terminals 13*a* to 13*d* and the lower row of contact terminals 14*a* to 14*d* are leaned against the multiple middle-section support structures 1111 of the insulation base seat 111; the upper positioning insulation seat 112 and the lower positioning insulation seat 113 are used to fix the upper row of contact terminals 13*a* to 13*d* and the lower row of contact terminals 14*a* to 14*d* inside the tongue 12; and the outer housing 15 is fitted with the insulation seat 11 to complete the assembly of the bidirectional double-sided electrical connector 1. Next, the outer housing 15 covers the floating tongue 12 from four sides, and the opening of the outer housing 15 is formed into an upper connection slot 161 and a lower connection slot 162. The floating tongue 12 may offset vertically in the middle sections of the upper connection slot 161 and the lower connection slot 162 in response to the structures of the multiple resilient members 122. Thus, the double-sided docking between the bidirectional double-sided electrical connector 1 and the complementary electrical connector may be performed. Referring continuously to FIG. 6, for the one single row arrangement of the pins of the upper row of contact terminals 13*a* to 13*d* and the lower row of contact terminals of the bidirectional double-sided electrical connector 1 (the upper pin 134*a* and the lower pin 144*a* depicted in the drawing), the one single row of pins may be used to bond the bidirectional double-sided electrical connector 1 to the circuit board (not shown).

Furthermore, the thickness dimension of the floating tongue 12 satisfies the specification of USB Association USB 2.0 A Type socket standard 1.84 mm±0.05 mm. The heights and widths of the connection slot 161 and 162 of the bidirectional double-sided connector 1 satisfy a standard specification of a USB 2.0 A Type socket of USB Association.

Referring continuously to FIG. 9, the floating tongue 12 further includes an insulation baffle 123, the upper row of contact terminals 13*b* to 13*d* and the lower row of contact terminals 14*a* to 14*d* are embedded into (or lie on or depressedly disposed) the elastically-movable-connection-point movement regions of the top and bottom sides of the floating tongue 12, and insulation baffle 123 separate the upper row of contact terminals 13*b* to 13*d* from the lower row of contact terminals 14*a* to 14*d*. The elastic-movement terminal slots 1211 have through slots 1212 separated by the insulation baffle 123 to storage multiple upper elastic movable connection points 131*a* to 131*d* and multiple lower elastic movable connection points 141*a* to 141*d* therein. The so-called elastically-movable-connection-point movement regions refer to the regions covering the multiple elastic-movement terminal slots 1211 and the multiple through slots 1212 in the floating tongue 12. In another embodiment, two through slots may also be formed in each elastic-movement terminal slot. In addition, the plate body 121 of the floating tongue 12 presents a water drop type or a structure having a thicker front section and a gradually reduced rear section. That is, the rear section thereof is a taper type structure, so that the shape of the water drop type can prevent the contact terminals from contacting the metal shell body to get short-circuited when the bidirectional double-sided electrical connector 1 and the complementary electrical connector are docking with each other. Furthermore, the distance between the front end of the plate body 121 of the floating tongue 12 and the insertion port is greater than a standard specification of a USB 2.0 A Type socket of USB Association. That is, the length of the plate body 121 of the floating tongue 12 is shorter than the Association's standard, or the floating tongue 12 is contracted inwards the front edge of the insertion port than the Association's standard. Such the design can prevent the improper force from damaging the contact terminals in the docking process.

Figure 10:
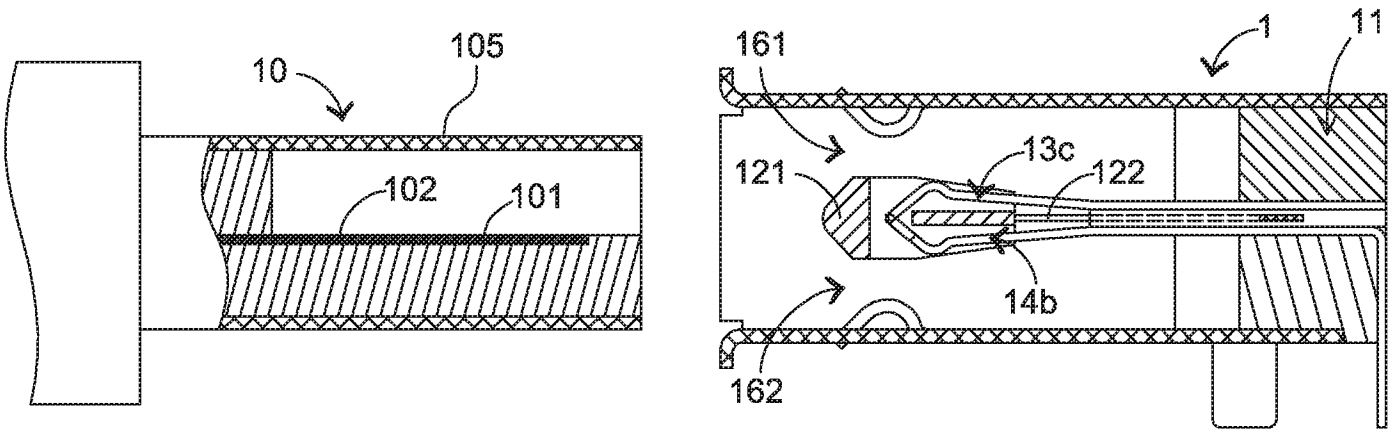
FIG. 10 is a schematically cross-sectional view showing a structure of the bidirectional double-sided electrical connector according to the first preferred embodiment of the invention in the early term of the docking process with the complementary electrical connector.
Figure 11:
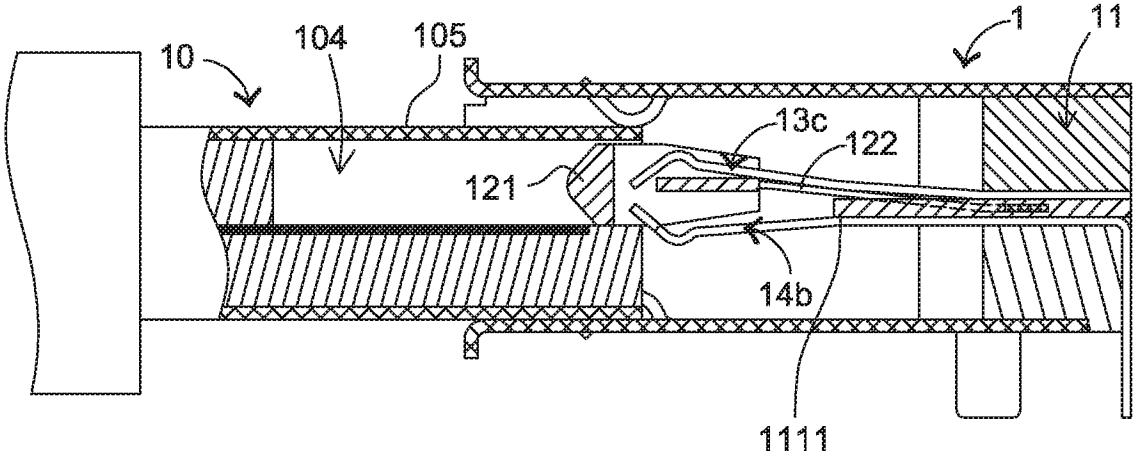
FIG. 11 is a schematically cross-sectional view showing a structure of the bidirectional double-sided electrical connector according to the first preferred embodiment of the invention in the medium term of the docking process with the complementary electrical connector.
Figure 12:
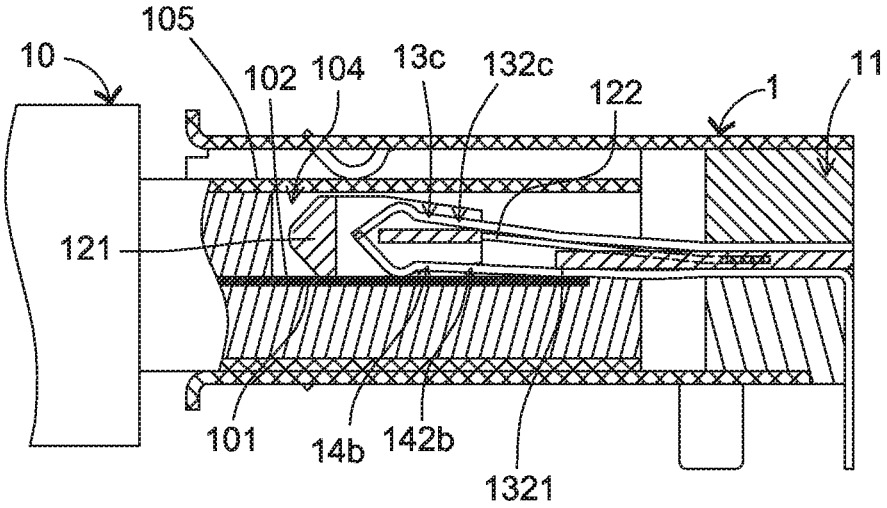
FIG. 12 is a schematically cross-sectional view showing a structure of the bidirectional double-sided electrical connector according to the first preferred embodiment of the invention in the late term of the docking process with the complementary electrical connector.
Figure 13:
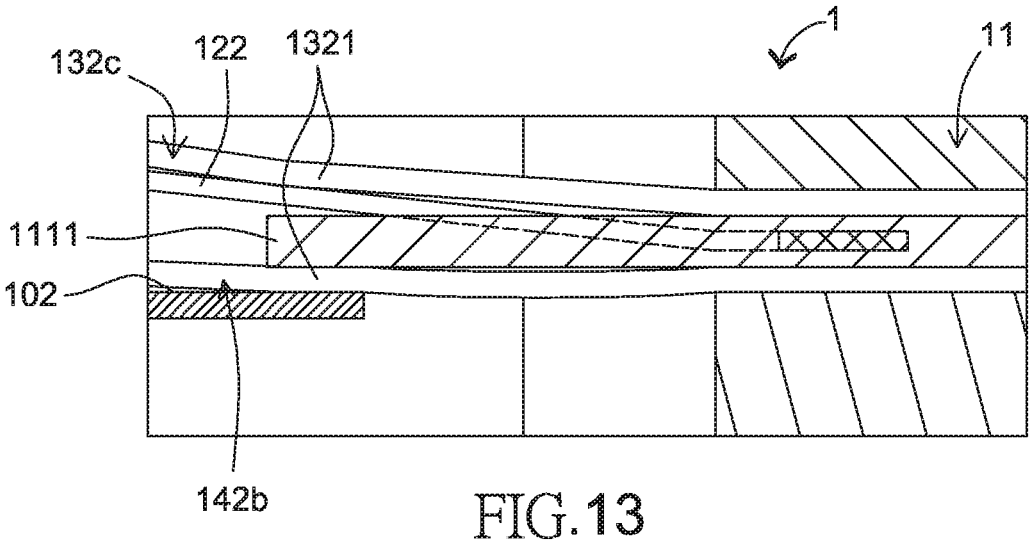
FIG. 13 is a schematic enlarged view showing a partial structure of the support structure of FIG. 12 close to the middle section.

Next, the docking operation condition between the bidirectional double-sided electrical connector 1 and the complementary electrical connector 10 will be described. FIGS. 10 to 12 are respectively schematically cross-sectional views showing the structure in the docking process between the bidirectional double-sided electrical connector of the first preferred embodiment and the complementary electrical connector. FIG. 13 is a schematic enlarged view showing the partial structure of the support structure of FIG. 12 close to the middle section 1111. Referring to FIG. 10, a complementary electrical connector 10 includes a connection plate 101 and multiple connection points 102 disposed on the surface of the connection plate 101. In this case, the complementary electrical connector 10 is only aligned with the bidirectional double-sided electrical connector 1 without docking. Referring to FIG. 11, complementary electrical connector 10 gradually enters the bidirectional double-sided electrical connector 1 from the front edge of the connection slot, the connection plate 101 pushes the floating tongue 12 floatingly disposed in the middle sections of the upper connection slot 161 and the lower connection slot 162 to offset upwards. In this case, the upper elastic movable connection points 131*a* to 131*d* and the lower elastic movable connection points 141*a* to 141*d* positioned on the insulation seat 11 and respectively arranged on the top and bottom sides of the floating tongue 12 respectively generate the corresponding to position differences in response to the upward offset of the floating tongue 12. That is, height differences are generated between the lower elastic movable connection points 141*a* to 141*d*, projecting beyond the lower surface of the floating tongue 12, and the lower surface of the floating tongue 12.

The pushing of the connection plate 101 bends the multiple resilient members 122, and the plate body 121 offsets upwards and partially enters the connection slot 104 of the complementary electrical connector 10. Meanwhile, the upward offset of the plate body 121 makes the lower elastic movable connection points 141*a* to 141*d* be not stored in the multiple elastic-movement terminal slots 1211 and be exposed outside the floating tongue 12. On the other hand, the upper elastic movable connection points 131*a* to 131*d* disposed on the other side of the plate body 121 further stretch into multiple elastic-movement terminal slots 1211 due to the upward offset of the plate body 121, and are disposed on deep portions of the multiple elastic-movement terminal slots 1211. Next, the sections of the upper elastic movable extensions 132*a*, 132*b*, 132*c* and 132*d* and the lower elastic movable extensions 142*a*, 142*b*, 142*c* and 142*d* corresponding to the middle-section support structures 1111 of the insulation seat 11 are referred to as middle section support segments 1321. When viewed from any middle section support segment 1321 as the fulcrum, the elastically movable extension between the middle section support segment 1321 and the corresponding elastically movable connection point forms a front-section arm of force, the elastically movable extension between the middle section support segment 1321 and the corresponding fixing portion forms a rear-section arm of force. In the docking process, when or after any front-section arm of force is pressed, the rear-section arm of force is open, so the rear-section arm of force can present the reverse protrusion. The so-called open rear-section arm of force refers to that the top of the elastically movable extension between the middle section support segment 1321 and the corresponding fixing portion is not pressed by the insulation seat 11, so the front section arm of force can synchronously resiliently deform upon being forced.

Thereafter, the complementary electrical connector 10 is continuously pushed in the direction toward the insulation seat 11, so that the plate body 121 completely enters the connection slot 104 of the complementary electrical connector 10, the lower elastic movable connection points 141*a* to 141*d* are respectively in direct contact with and directly electrically connected to the multiple connection points 102, and the plate body 121 is finally pushed to change to the angle of contacting the connection plate 101, as shown in FIG. 12. Thus, the electrical connections between the lower row of contact terminals 14*a* to 14*d* and the multiple connection points 102 can be formed to perform the transmission of the signal and electric power. On the contrary, the docking operation condition between the complementary electrical connector 10 and the lower connection slot 162 is similar except that the operation condition of the partial structure is reversed: the connection plate 101 of the complementary electrical connector 10 enters the upper connection slot 161 of the bidirectional double-sided electrical connector 1, the plate body 121 offsets downwards, the upper elastic movable connection points 131*a* to 131*d* are exposed out of the floating tongue 12, and the lower elastic movable connection points 141*a* to 141*d* further stretch into multiple elastic-movement terminal slots 1211.

Three points are to be described. First, the lower row of contact terminals 14*a* to 14*d* lean against the multiple middle-section support structures 1111 of the insulation base seat 111, and the upper positioning insulation seat 112 and the lower positioning insulation seat 113 fix the lower row of contact terminals 14*a* to 14*d* to the insulation base seat 111, so that the structure can provide the following advantages. In the process when the lower elastic movable connection points 141*a* to 141*d* are pushed by the connection plate 101, the arms of force of the lower row of contact terminals 14*a* to 14*d* being pushed to move upwards are shortened because of the above-mentioned structure. According to the principles of stress, it is obtained that the shortening of the arms of force can increase the contact forces between the lower row of contact terminals 14*a* to 14*d* and the multiple upper connection points 102, and ease the elastic fatigues of the lower row of contact terminals 14*a* to 14*d* at the same time.

Second, in the process when the lower elastic movable connection points 141*a* to 141*d* are pushed by the connection plate 101, the lower elastic movable connection points 141*a* to 141*d* are pushed in the directions toward the upper elastic movable connection points 131*a* to 131*d* and approach the upper elastic movable connection points 131*a* to 131*d*. However, the upper elastic movable connection points 131*a* to 131*d* of the invention cannot be pushed upwards by the lower elastic movable connection points 141*a* to 141*d* to contact the complementary electrical connector 10. The reasons reside in that the arrangement directions of the upper bevel guides 1311*a* to 1131*d* of the upper row of contact terminals 13*a* to 13*d* are different from the arrangement directions of the lower bevel guides 1411*a* to 1411*d* of the lower row of contact terminals 14*a* to 14*d*, so that they can be staggered, and the lower elastic movable connection points 141*a* to 141*d* cannot upwardly push the upper row of contact terminals 13*a* to 13*d* to prevent the upper row of contact terminals 13*a* to 13*d* from contacting the complementary electrical connector 10 to cause the short-circuit condition.

Third, upon docking, the offset of the floating tongue 12 makes the upper elastic movable connection points 131*a* to 131*d* offset in the direction away from the surface of the floating tongue 12, that is, the upper elastic movable connection points 131*a* to 131*d* are lower than the surface of the floating tongue 12, to prevent the upper elastic movable connection points 131*a* to 131*d* from contacting the metal housing body 105 of the complementary electrical connector 10 to cause the short-circuit.

Figure 15:
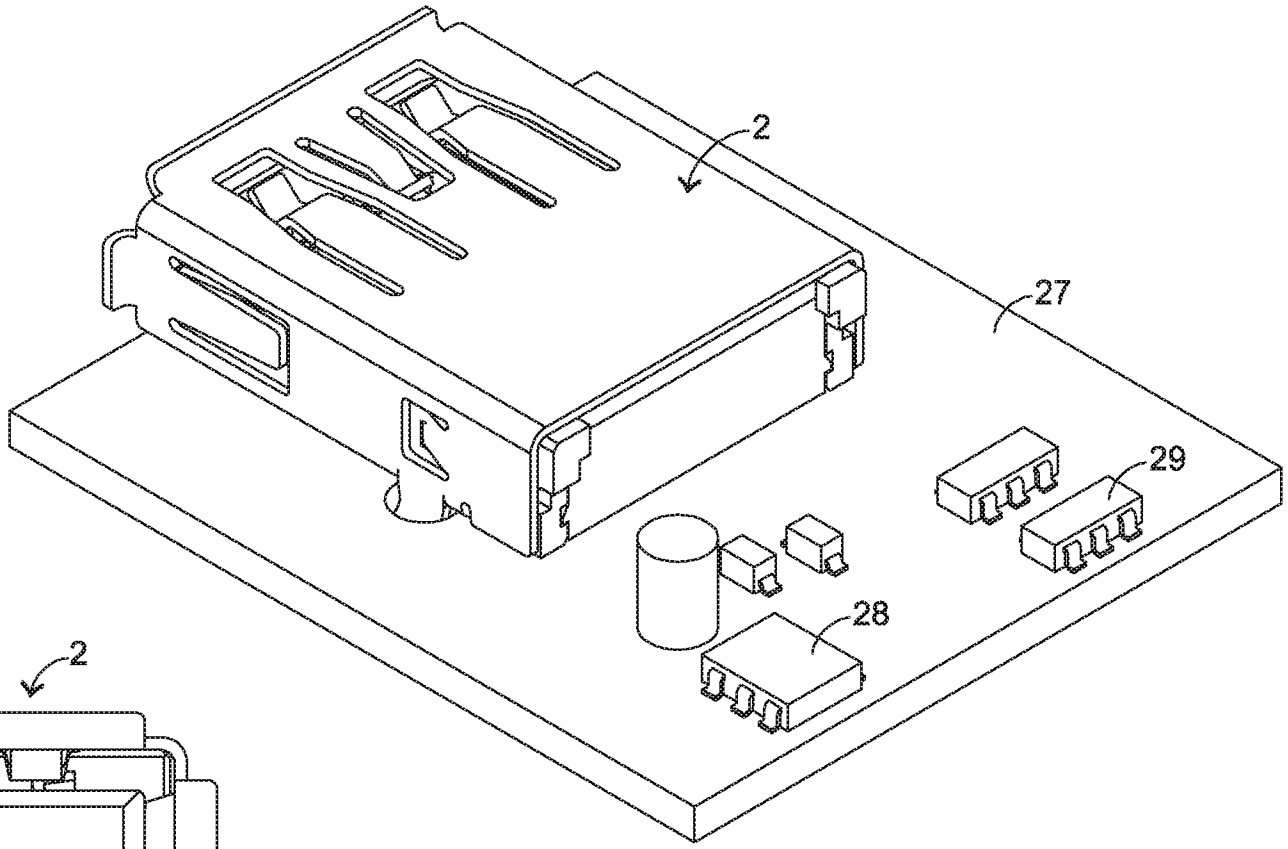
FIG. 15 is a pictorial side view showing the bidirectional double-sided electrical connector according to the second preferred embodiment of the invention bonded to the circuit board.
Figure 14:
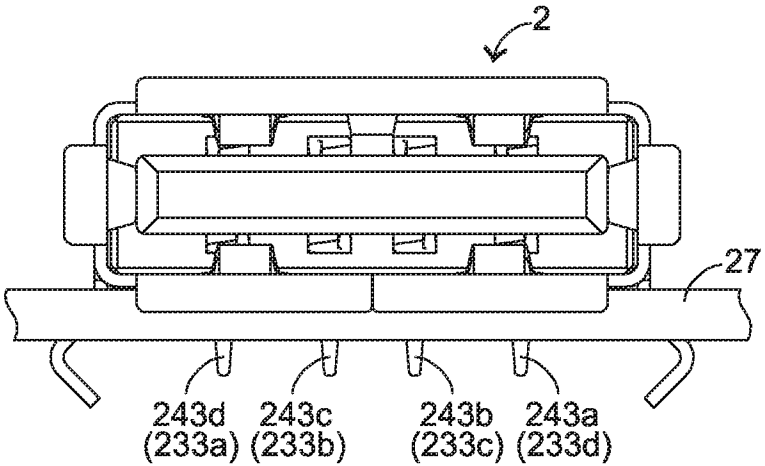
FIG. 14 is a schematic front view showing the structure of the bidirectional double-sided electrical connector according to the second preferred embodiment of the invention bonded to the circuit board.

FIGS. 14 and 15 are respectively a schematic front view and a pictorial side view showing the structure of the bidirectional double-sided electrical connector according to the second preferred embodiment of the invention bonded to the circuit board. The bidirectional double-sided electrical connector 2 of the second preferred embodiment have the structure and operation principle substantially the same as those of the bidirectional double-sided electrical connector 1 of the first embodiment except for the differences of the outlook dimensional structure and the arrangements of the pins of the upper row of contact terminals 13*a* to 13*d* and the lower row of contact terminals 14*a* to 14*d*. The pins of the bidirectional double-sided electrical connector 2 are bonded to the circuit board 27. In the point of view of the upper pin 233*d* and the lower pin 243*a*, the multiple upper and lower pins of the bidirectional double-sided electrical connector 2 are arranged in front and rear rows in a front-to-rear overlapped manner or a front-to-rear staggered manner. Referring to FIG. 15, a control chip 28 and multiple electrical elements 29 are disposed on the circuit board 27, wherein the control chip 28 may include one or multiple ones of the following functions. First, it can manage the signal and electric power received by the bidirectional double-sided electrical connector 2, and transmit the signal and electric power thereof. Second, it has the surge protection function to protection the circuit board 27 and the multiple electrical elements 29. Third, it has the anti-short-circuit function to prevent or neutralize the short-circuit condition.

Figure 17:
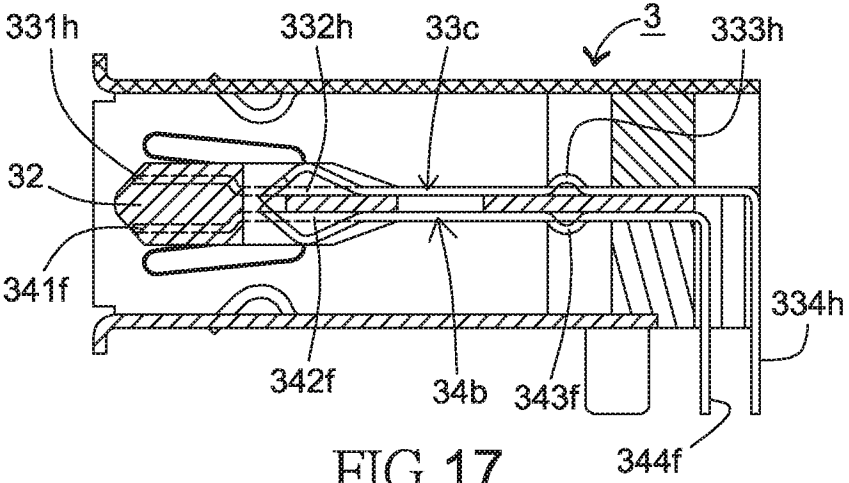
FIG. 17 is a schematic front view showing the structure of the bidirectional double-sided electrical connector according to the third preferred embodiment the invention.
Figure 18:
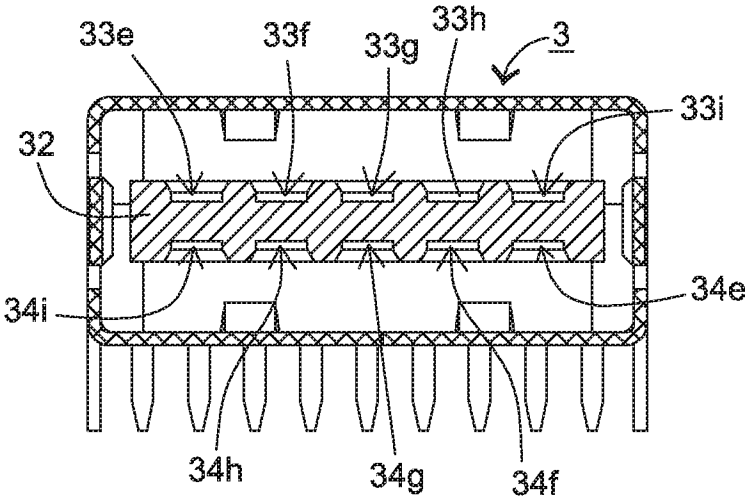
FIG. 18 is a schematically cross-sectional view showing a structure of the bidirectional double-sided electrical connector according to the third preferred embodiment the invention.
Figure 16:
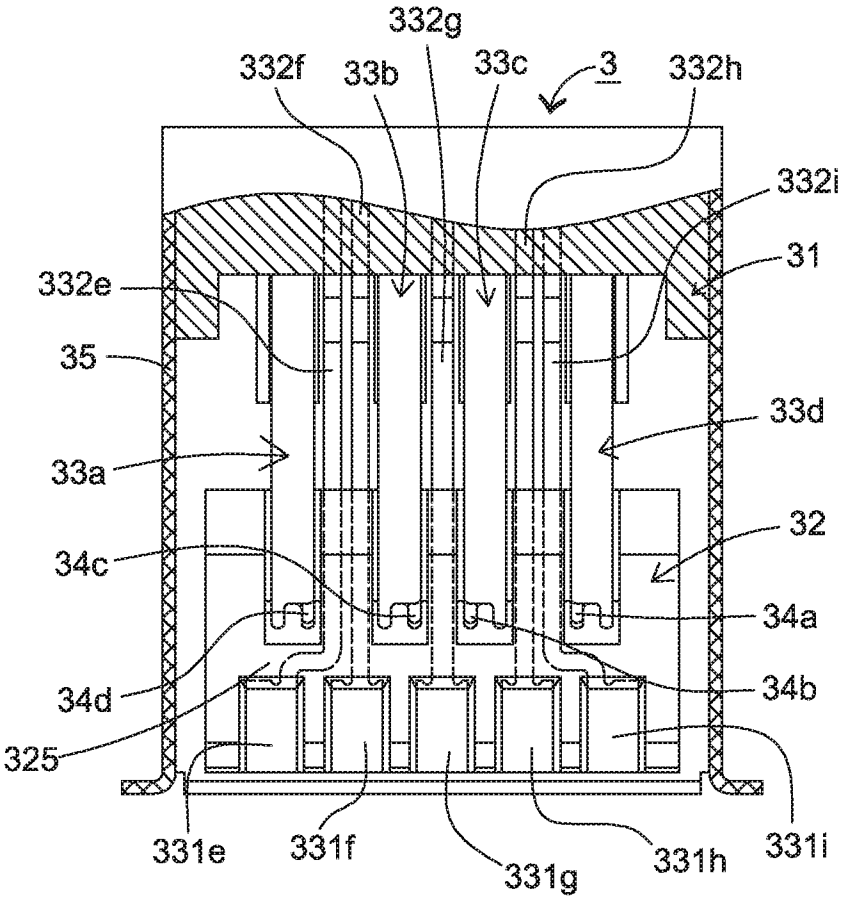
FIG. 16 is a schematic top view showing the cross-section of the structure of the bidirectional double-sided electrical connector according to the third preferred embodiment the invention.

FIGS. 16, 17 and 18 are respectively a schematic top view showing the cross-section of the structure, a schematic front view showing the structure and a schematically cross-sectional view showing the structure in the bidirectional double-sided electrical connector according to the third preferred embodiment the invention. The bidirectional double-sided electrical connector 3 includes an insulation seat 31, a floating tongue 32, an upper row of contact terminals 33*a* to 33*i*, a lower row of contact terminals 34*a* to 34*i* and an outer housing 35, the structure of the third preferred embodiment is substantially the same as the above-mentioned embodiment, and detailed descriptions of the same portions will be omitted. The differences reside in that the bidirectional double-sided electrical connector 3 is a USB TYPE-A 3.0 electrical receptacle, so its additionally has the upper row of contact terminals 33*e* to 33*i* and the lower row of contact terminals 34*e* to 34*i*, wherein the upper row of contact terminals 33*e* to 33*i* and the lower row of contact terminals 34*e* to 34*i* are flat contact terminals.

Referring continuously to FIGS. 16 to 18, the upper row of contact terminal 33*h* will be described as an example. The upper row of contact terminal 33*h* includes an upper fixed connection point 331*h*, an elastic sheet segment 332*h*, a bent elastic movable portion 333*h* and an upper pin 334*h*. The upper fixed connection point 331*h* is fixed to and exposed from the upper surface of the floating tongue 32, and the elastic sheet segment 332*h* replaces the resilient member 122 of the preferred embodiment to connect the floating tongue 32 to the insulation base seat of the insulation seat 31, and provide the resilience to the floating tongue 32, so that the floating tongue 32 can offset vertically. The upper pin 334*h* may be connected to the circuit board or wire, and the bent elastic movable portion 333*h* has the bent structure to enhance the resilience of the elastic sheet segment 332*h*. The upper row of other contact terminals 33*e*, 33*f*, 33*g* and 33*i* have the structures substantially the same as the upper row of contact terminal 33*h*, and respectively have the upper fixed connection points 331*e*, 331*f*, 331*g* and 331*i*, which are integrally connected to the elastic sheet segments 332*e*, 332*f* and 332*i*, wherein they are only listed and will not be described in detail.

Referring continuously to FIGS. 16 to 18, the lower row of contact terminal 34*f* vertically corresponding to the upper row of contact terminal 33*h* will be described as an example, and includes a lower fixed connection point 341*f*, an elastic sheet segment 342*f*, a bent elastic movable portion 343*f* and a lower pin 344*f*, wherein the structure thereof is the same as the upper row of contact terminals 33*h*, and detailed descriptions thereof will be omitted. The structures of the lower row of other contact terminals 34*e*, 34*g*, 34*h* and 34*i* are also similar to the upper row of contact terminals 33*h*, and detailed descriptions thereof will be omitted.

In short, this preferred embodiment utilizes the upper row of added five contact terminals 33*e* to 33*i* and the lower row of added five contact terminals 34*e* to 34*i* as resilient members, so that the functions of the resilient members can be integrated into the USB TYPE-A 3.0 contact terminal to provide two functions in one single element.

Each of the upper and lower rows of flat contact terminals have five terminals. Each row of flat contact terminals satisfy the USB 3.0/3.1 specification of USB Association, wherein the middle terminal is the ground terminal (GND), the two side terminals are two pairs of signal terminals (RX+, RX−, GND, TX+, TX−), and the two rows of elastically movable connection points are located in back of the two rows of fixed connection points. The two pairs of signal terminals on two sides of the upper and lower rows of flat contact terminals are turned and adjacently embedded with a transversal separation column structure 325 between the fixed connection points of the tongue and the elastically movable contact.

It is to be specified that the above-mentioned bidirectional double-sided electrical connector of the invention may adopt the USB TYPE-A 2.0 contact terminal and USB TYPE-A 3.0 contact terminal, which are only exemplified and do not intend to restrict the invention thereto. In the actual fact, the bidirectional double-sided electrical connector of the invention may also adopt the USB TYPE-A 3.1 contact terminals No matter which contact terminals of transmission interfaces are adopted, they satisfy the inventive essence of the invention as long as they can be implemented in the structure of the bidirectional double-sided electrical connector of the invention. So, they should be included in the scope of the invention.

Figure 20:
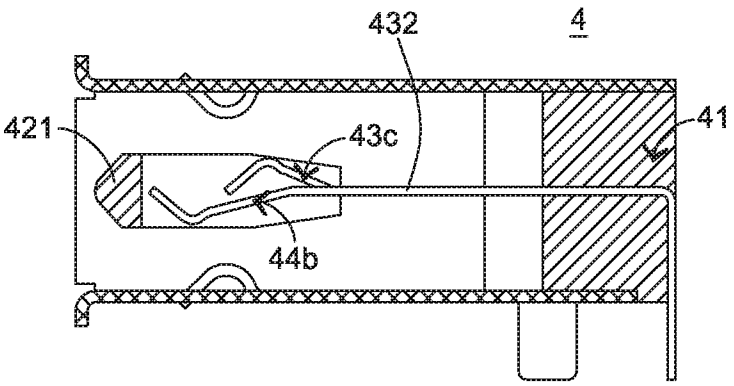
FIG. 20 is a schematically cross-sectional view showing a structure of the bidirectional double-sided electrical connector according to the fourth preferred embodiment of the invention.
Figure 19:
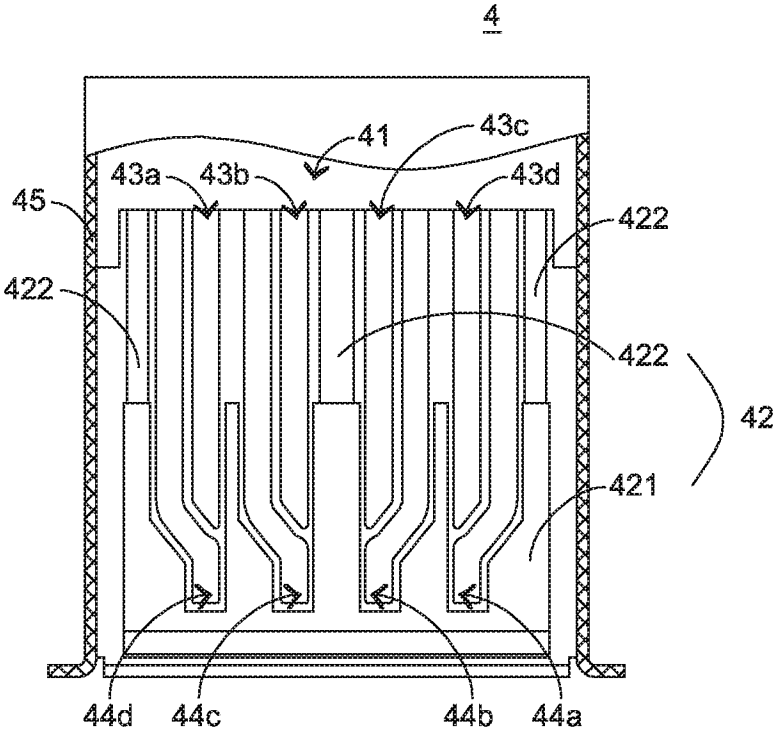
FIG. 19 is a schematic top view showing the cross-section of the structure of the bidirectional double-sided electrical connector according to the fourth preferred embodiment of the invention.

Next, FIGS. 19 and 20 are respectively a schematic top view and a schematic view showing the cross-section of the structure in the bidirectional double-sided electrical connector according to the fourth preferred embodiment of the invention. The bidirectional double-sided electrical connector 4 includes an insulation seat 41, a floating tongue 42, an upper row of contact terminals 43*a* to 43*d*, a lower row of contact terminals 44*a* to 44*d* and an outer housing 45. Next, the plate body 421 of the floating tongue 42 is connected to the insulation seat 41 through multiple resilient members 422. The structure of fourth embodiment is substantially the same as the above-mentioned embodiment, wherein the same portions and detailed descriptions thereof will be omitted. The differences reside in that the two rows of contact terminals of the first preferred embodiment are made of two metal material sheets, but the structure of the upper row of contact terminals 43*a* to 43*d* and the lower row of contact terminals 44*a* to 44*d* of the fourth embodiment may be made of one single metal material sheet, and the upper row of contact terminals 43*a* to 43*d* and the lower row of contact terminals 44*a* to 44*d* are deployed and arranged in front and rear rows on the same metal material without overlapping. Thus, the upper row of contact terminals 43*a* to 43*d* and the lower row of contact terminals 44*a* to 44*d* of the fourth embodiment only need to use one metal material sheet, so that the manufacturing cost can be decreased. Next, regarding the front edge of the plate body 421, the upper row of contact terminals 43*a* to 43*d* are contracted inwards much more then the lower row of contact terminals 44*a* to 44*d*. That is, the lower row of contact terminals 44*a* to 44*d* are closer to the front edge of the plate body 421, but both of them may be electrically connected to the complementary electrical connector upon docking.

Figure 21:
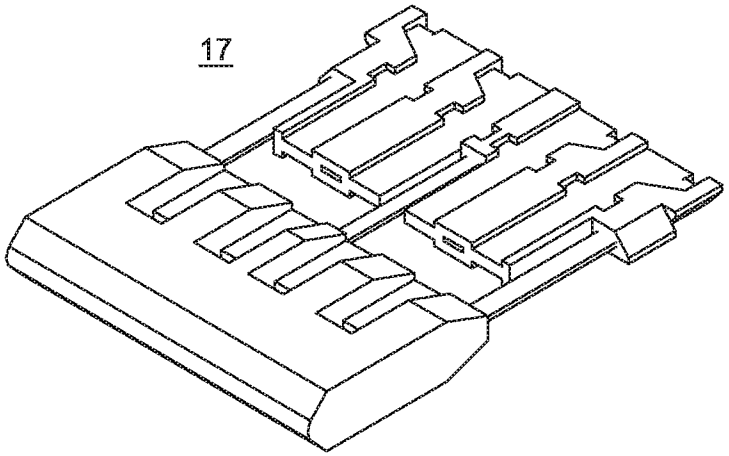
FIG. 21 is a schematic structure view showing the bidirectional double-sided electrical connector of the invention molded using one of different processes.

Next, the bidirectional double-sided electrical connectors of the invention manufactured by different molding method will be described in the following. FIGS. 21 to 24 are respectively schematic structure views showing the bidirectional double-sided electrical connectors of the invention molded using different processes. FIG. 21 shows the combination structure of the plate body of the floating tongue, the resilient members and the insulation base seat, wherein the resilient members are embedded and injection molded, and two ends of the resilient member are molded to form the plate body and the insulation base seat. Then, the first combination structure 17 may be used to form the structure of the insulation seat through the assembling method of the upper positioning insulation seat 112 and the lower positioning insulation seat 113 in the first preferred embodiment.

Figure 22:
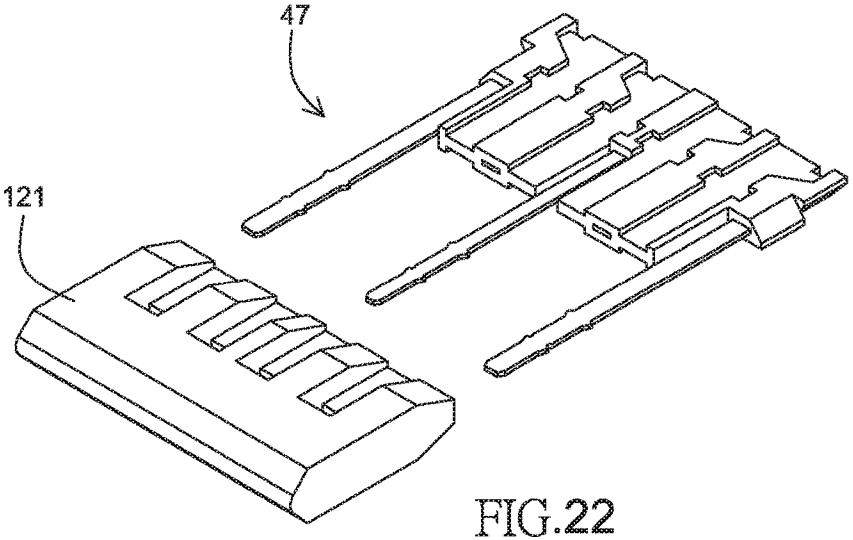
FIG. 22 is a schematic structure view showing the bidirectional double-sided electrical connector of the invention molded using one of different processes.
Figure 23:
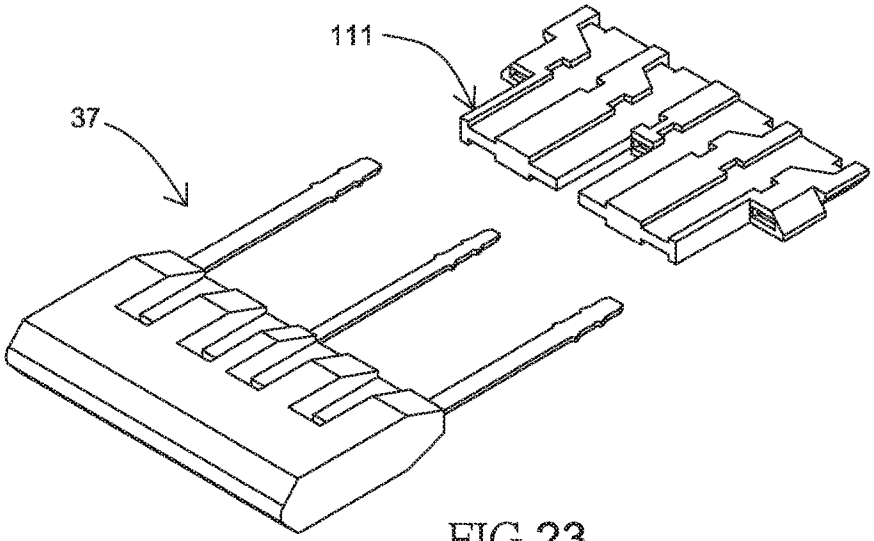
FIG. 23 is a schematic structure view showing the bidirectional double-sided electrical connector of the invention molded using one of different processes.

FIG. 22 adopts the assembling method to combine the plate body, the resilient members and the insulation base seat. First, the resilient members are assembled on the insulation base seat to form a first assembly structure 47, then the plate body 121 and the resilient members are combined, and finally the assembling method of the upper positioning insulation seat 112 and the lower positioning insulation seat 113 may also be used to form the structure of the insulation seat. FIG. 23 adopts another different assembling method, wherein the plate body and the resilient members are assembled to form a second assembly structure 37, and then the resilient members are combined with the insulation base seat 111. The subsequent molding operation of the insulation seat is similar to the assembling method of the first embodiment, and the embedding and injection molding technique may also be performed to mold the insulation seat 51, which is produced by the non-assembling method. Such the combination structure may be applied to the bidirectional double-sided electrical connector 5, wherein the insulation seat 51 has no gap, as shown in FIGS. 24 and 25.

Figure 24:
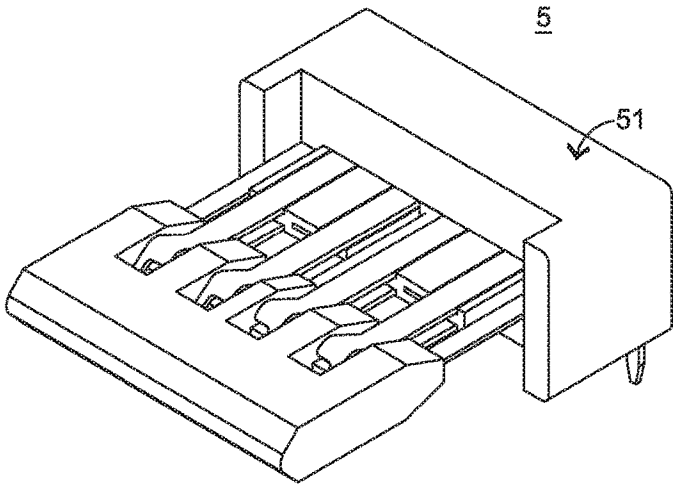
FIG. 24 is a schematic structure view showing the bidirectional double-sided electrical connector of the invention molded using one of different processes.
Figure 25:
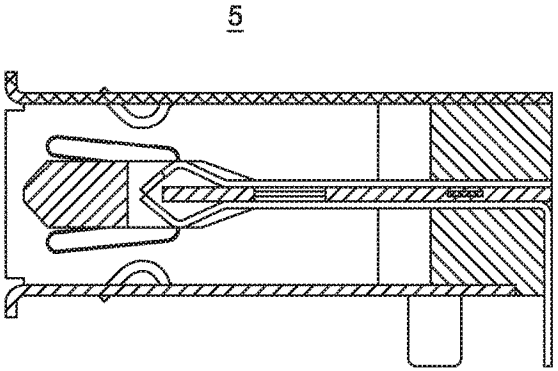
FIG. 25 is a schematic structure view showing the bidirectional double-sided electrical connector of the invention molded using one of different processes.

In summary, the bidirectional double-sided electrical connector of the invention may adopt the methods of FIGS. 21 to 23 to mold the plate body, the resilient members and the insulation base seat, wherein the insulation base seat may be molded into the insulation seat using the assembling method of the first embodiment and the secondary embedding and injection molding method shown in FIGS. 24 and 25.

Figure 27:
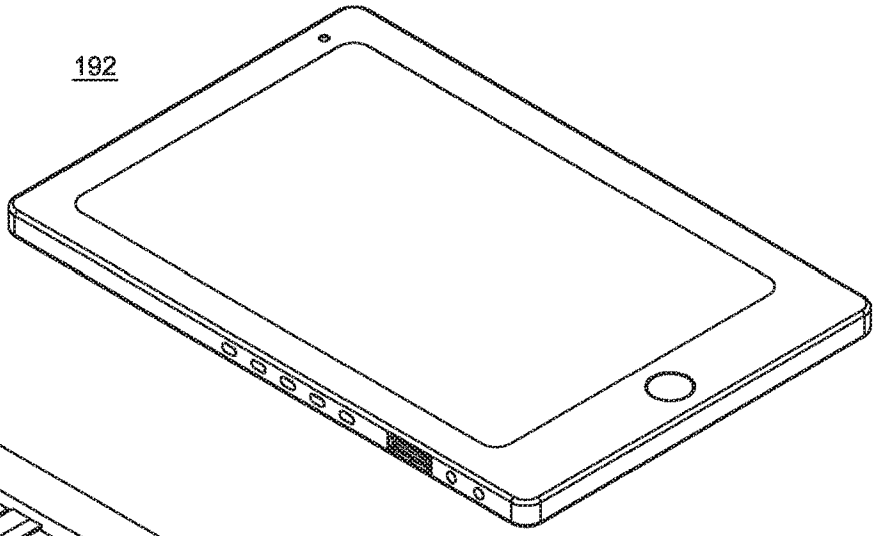
FIG. 27 is a schematic structure view showing the bidirectional double-sided electrical connector of the invention applied to the tablet computer.
Figure 28:
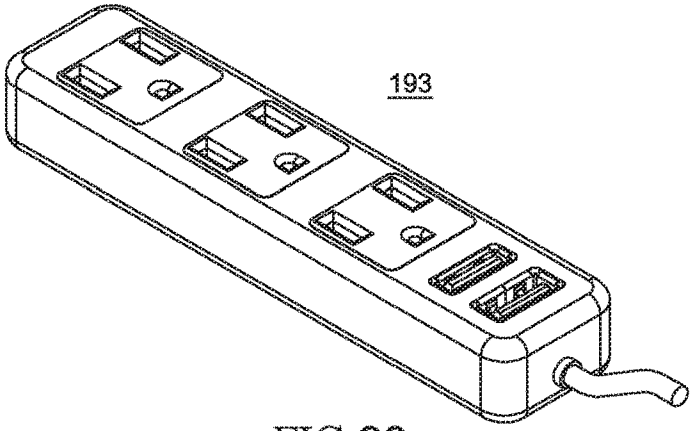
FIG. 28 is a schematic structure view showing the bidirectional double-sided electrical connector of the invention applied to the extension-cable bidirectional socket.
Figure 26:
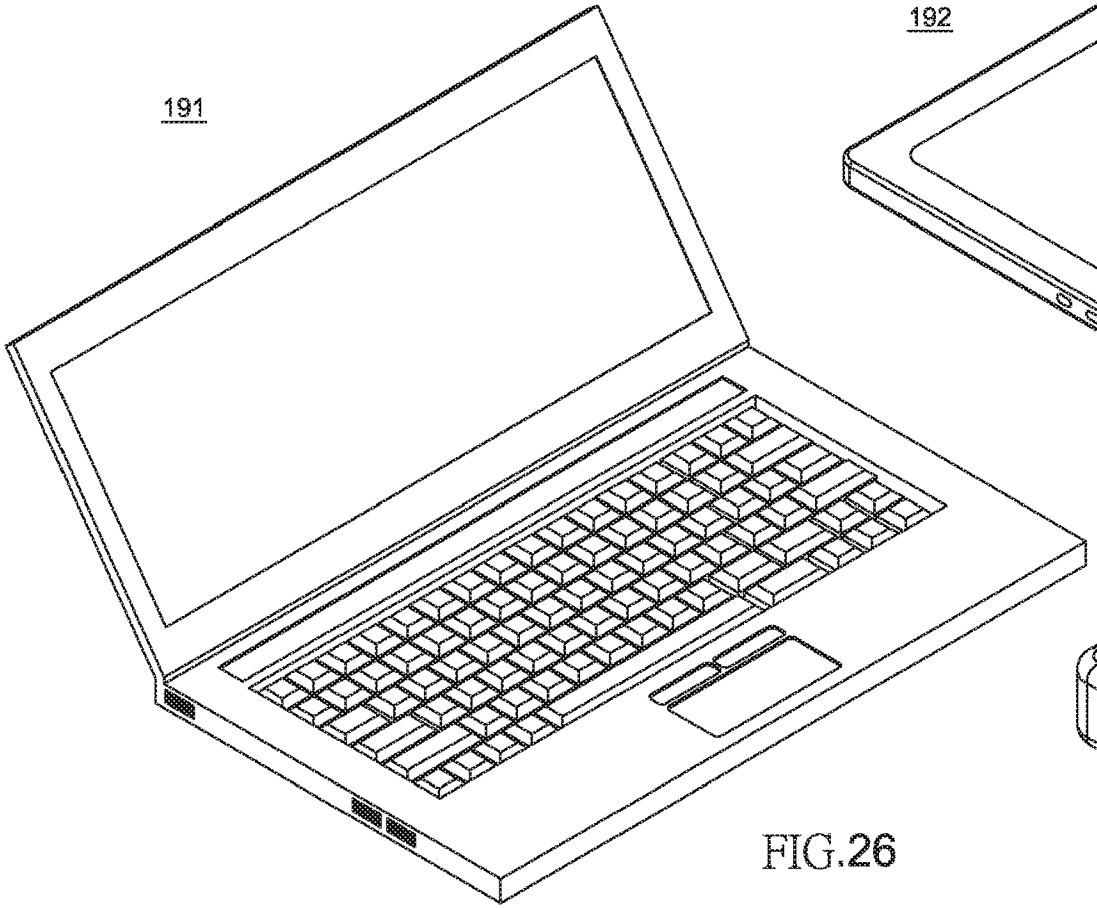
FIG. 26 is a schematic structure view showing the bidirectional double-sided electrical connector of the invention applied to the notebook computer.
Figure 31:
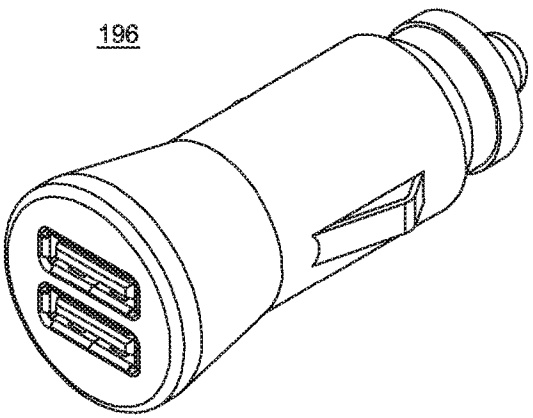
FIG. 31 is a schematic structure view showing the bidirectional double-sided electrical connector of the invention applied to the automotive charger.
Figure 32:
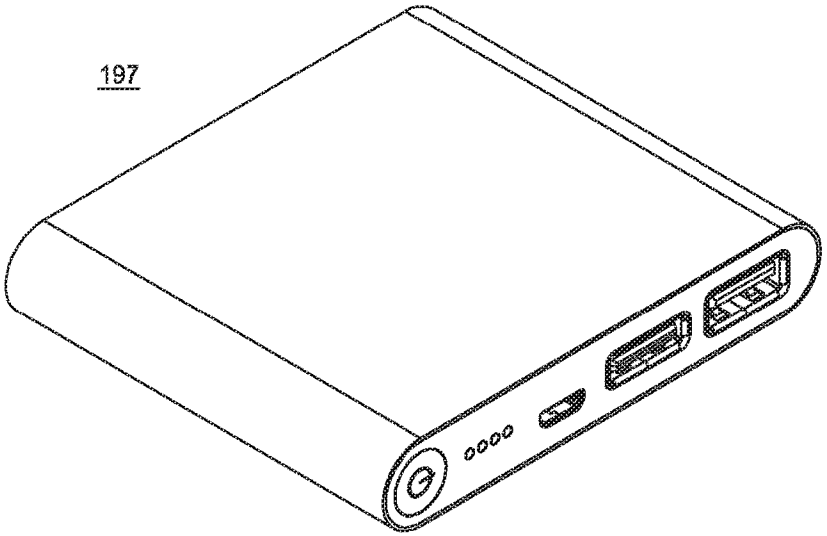
FIG. 32 is a schematic structure view showing the bidirectional double-sided electrical connector of the invention applied to the mobile power.
Figure 29:
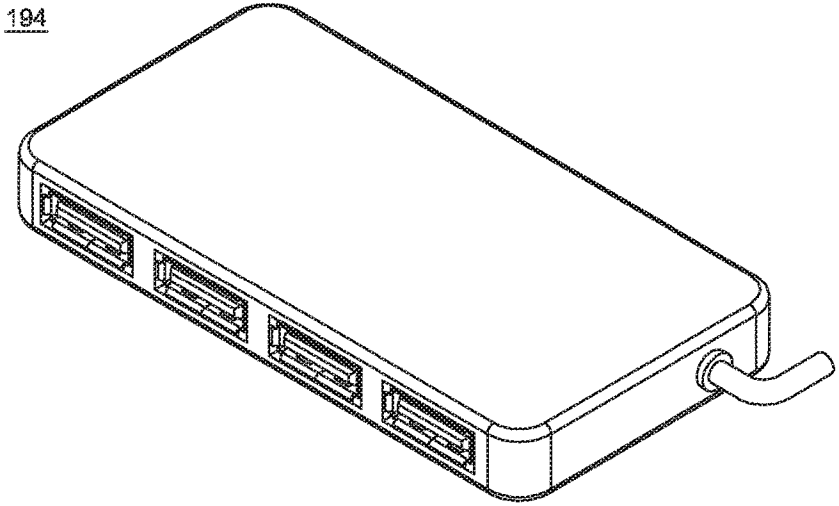
FIG. 29 is a schematic structure view showing the bidirectional double-sided electrical connector of the invention applied to the hub expander.
Figure 30:
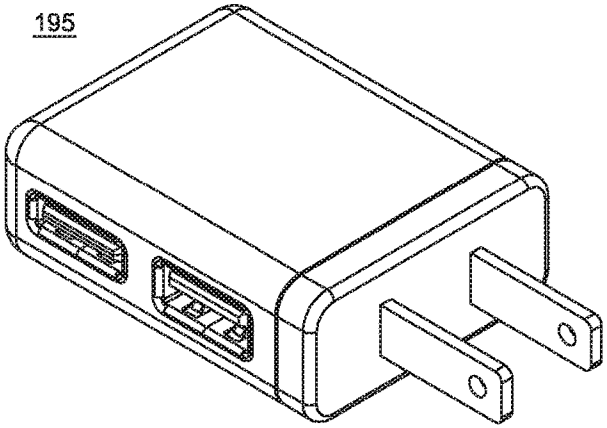
FIG. 30 is a schematic structure view showing the bidirectional double-sided electrical connector of the invention applied to the household switch socket/charger.

Referring sequentially to FIGS. 26 to 39, which are schematic structure views showing electronic devices to which the bidirectional double-sided electrical connector of the invention may be applied. The bidirectional double-sided electrical connector of the invention may be applied to various electronic devices, such as the notebook computer 191 of FIG. 26 having the bidirectional double-sided electrical connector, the tablet computer 192 of FIG. 27 having the bidirectional double-sided electrical connector, the extension-cable bidirectional socket 193 of FIG. 28 having the bidirectional double-sided electrical connector, the hub expander 194 of FIG. 29 having the bidirectional double-sided electrical connector, the household switch socket/charger 195 of FIG. 30 having the bidirectional double-sided electrical connector, the automotive charger 196 of FIG. 31 having the bidirectional double-sided electrical connector or the mobile power 197 of FIG. 32 having the bidirectional double-sided electrical connector.

Figure 33:
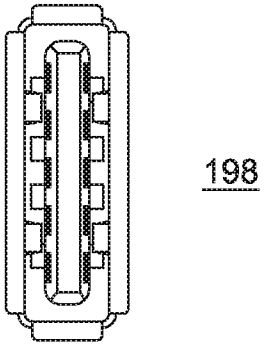
FIG. 33 is a schematic view at a viewing angle showing the bidirectional double-sided electrical connector of the invention applied to the adapter cable.
Figure 34:
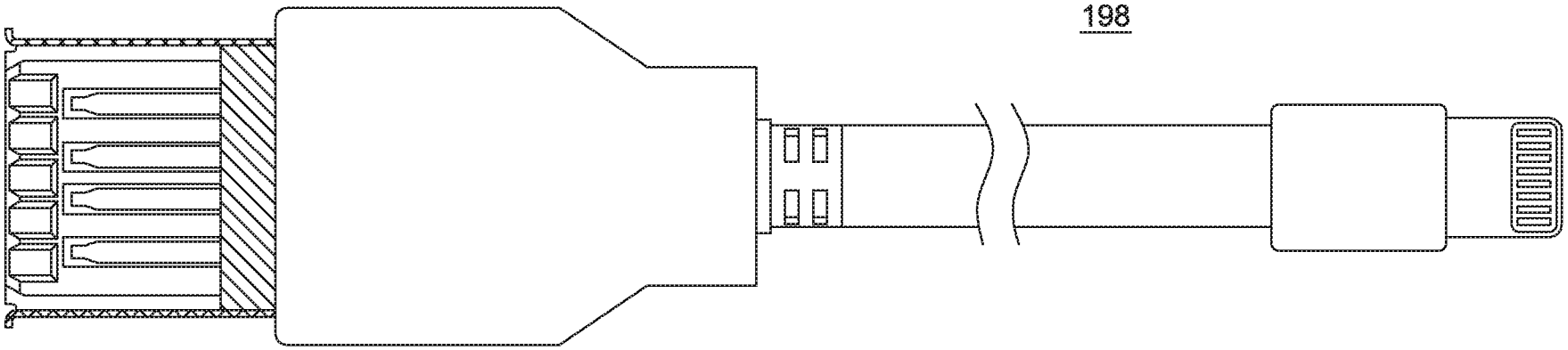
FIG. 34 is a schematic view at a viewing angle showing the bidirectional double-sided electrical connector of the invention applied to the adapter cable.
Figure 37:
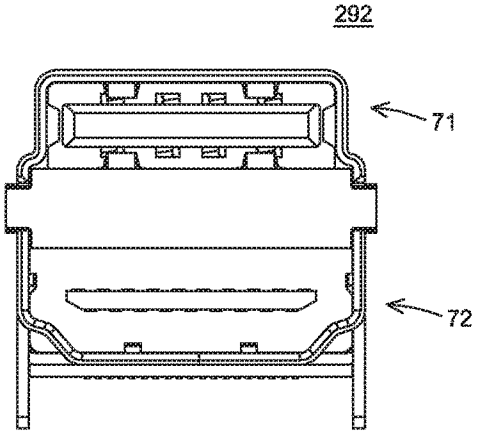
FIG. 37 is a schematic structure view showing the bidirectional double-sided electrical connector of the invention applied to the stacked electrical receptacles.
Figure 38:
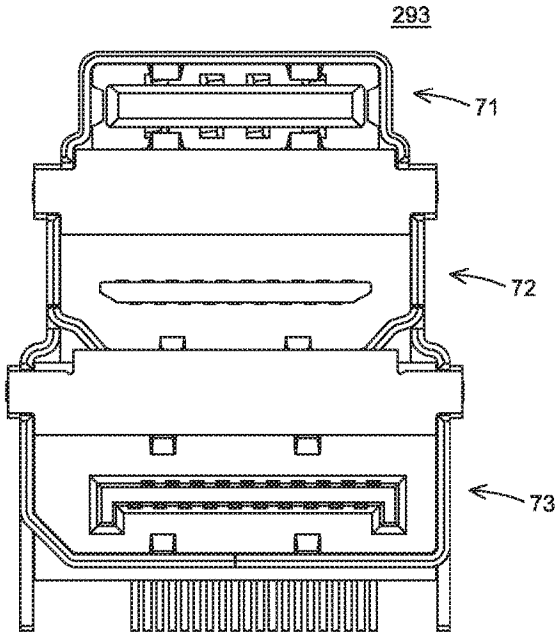
FIG. 38 is a schematic structure view showing the bidirectional double-sided electrical connector of the invention applied to the stacked electrical receptacles.
Figure 36:
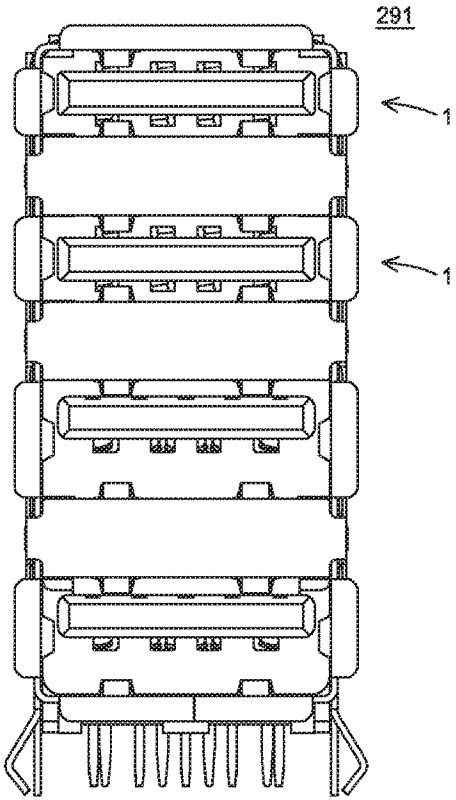
FIG. 36 is a schematic structure view showing the bidirectional double-sided electrical connector of the invention applied to the stacked electrical receptacles.
Figure 35:
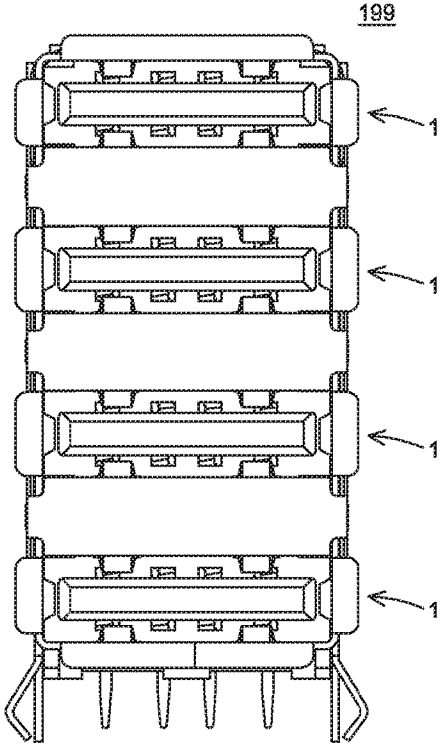
FIG. 35 is a schematic structure view showing the bidirectional double-sided electrical connector of the invention applied to the stacked electrical receptacles.
Figure 40:
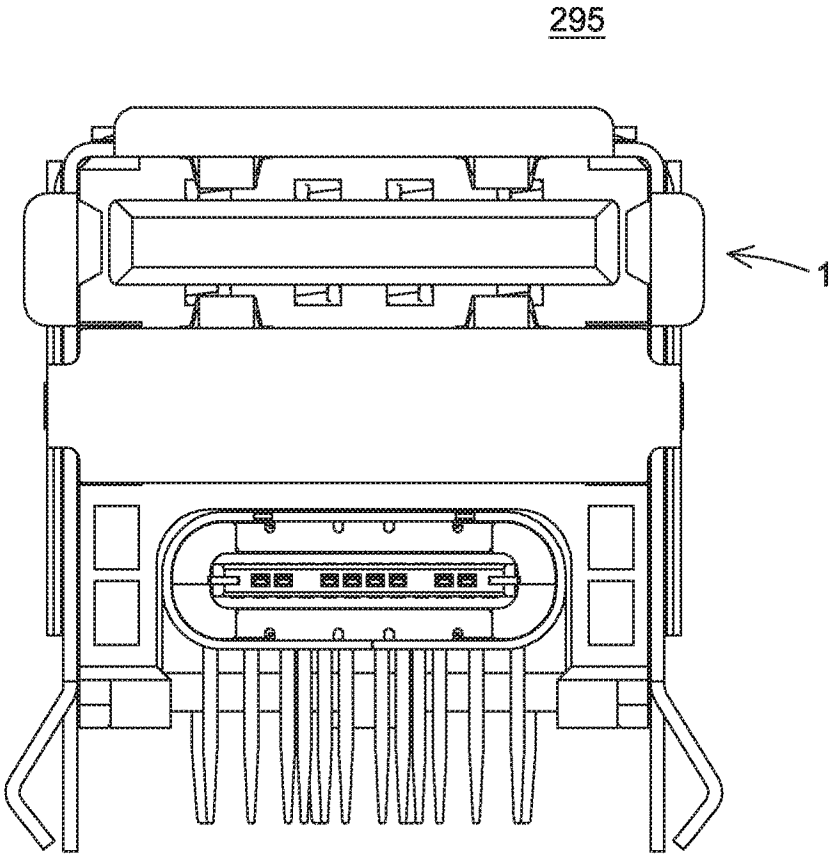
FIG. 40 is a schematic structure view showing the bidirectional double-sided electrical connector of the invention applied to the stacked elevated electrical receptacles.
Figure 39:
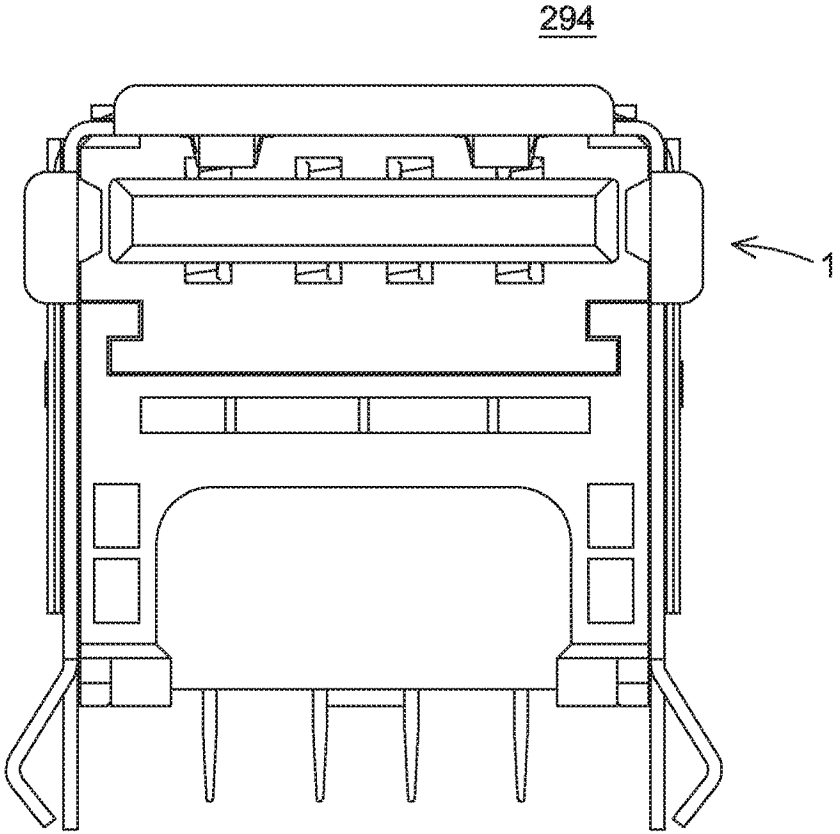
FIG. 39 is a schematic structure view showing the bidirectional double-sided electrical connector of the invention applied to the elevated electrical receptacle.

The bidirectional double-sided electrical connector of the invention may also be applied to: the adapter cable 198, as shown in different perspectives of FIGS. 33 and 34; the multilayer stacked electrical receptacle 199 of FIG. 35 having at least two bidirectional double-sided electrical connectors 1; the multilayer stacked electrical receptacle 291 of FIG. 36 having two bidirectional double-sided electrical connectors 1 and the unidirectional simplex electrical connector; or the mixed stacked electrical receptacle 292 of FIG. 37 stacked with electrical connector having another different connection interface (e.g., the bidirectional double-sided USB TYPE-A 2.0 interface 71 and the HDMI interface 72 are stacked). FIG. 38 shows the mixed stacked electrical receptacle 293 stacked with the electrical connector having other two different connection interfaces (e.g., the bidirectional double-sided USB TYPE-A 2.0 interface 71, HDMI interface 72 and Displayport interface 73 are stacked). FIG. 39 shows the elevated electrical receptacle 294 having the bidirectional double-sided electrical connector 1. FIG. 40 shows the mixed stacked elevated electrical receptacle 295 stacked with the electrical connector having another different connection interface.

Figure 41:
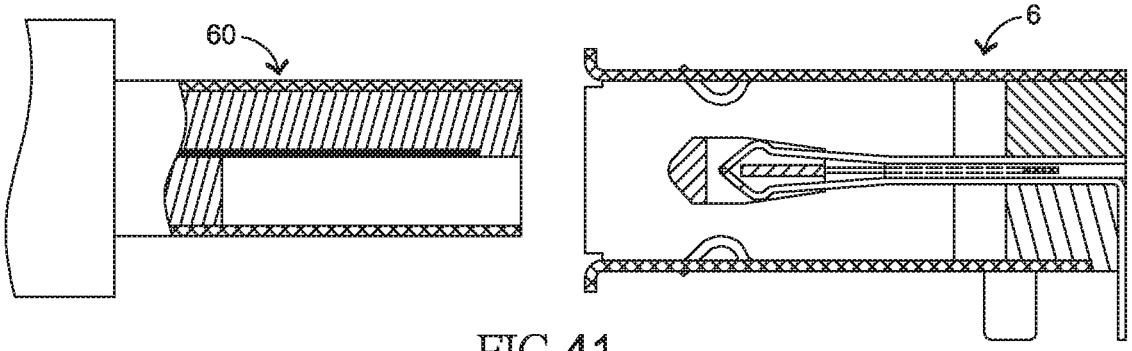
FIG. 41 is a schematically cross-sectional view showing a structure of the bidirectional double-sided electrical connector according to the fifth preferred embodiment of the invention in the early term of the forward docking process with the complementary electrical connector.
Figure 42:
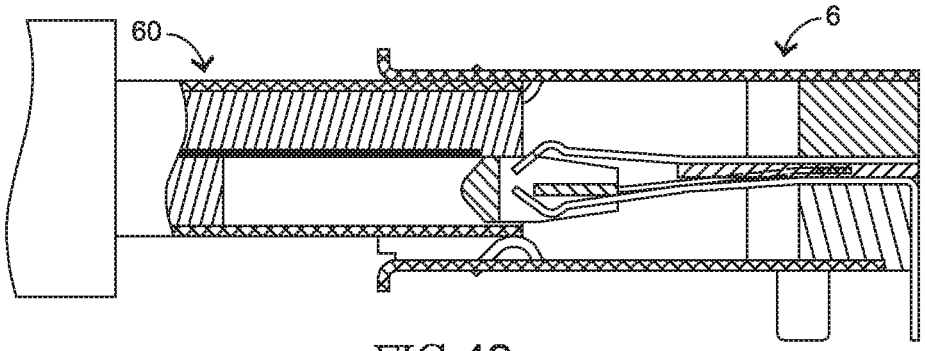
FIG. 42 is a schematically cross-sectional view showing a structure of the bidirectional double-sided electrical connector according to the fifth preferred embodiment of the invention in the medium term of the forward docking process with the complementary electrical connector.
Figure 43:
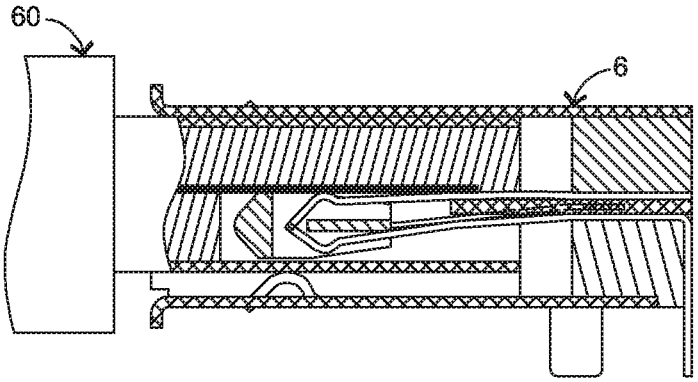
FIG. 43 is a schematically cross-sectional view showing a structure of the bidirectional double-sided electrical connector according to the fifth preferred embodiment of the invention in the late term of the forward docking process with the complementary electrical connector.

The reverse docking operation condition between the bidirectional double-sided electrical connector 6 and the complementary electrical connector 60 may be referred sequentially to FIGS. 41 to 43, which are respectively the schematically cross-sectional views showing the docking process of the structure of the bidirectional double-sided electrical connector 6 of the invention in the fifth preferred embodiment with the complementary electrical connector 60. Because the basic operation principle of the reverse docking process is substantially the same as the forward docking process in the first preferred embodiment shown in FIGS. 10 to 12, detailed descriptions thereof will be omitted.

Figure 44:
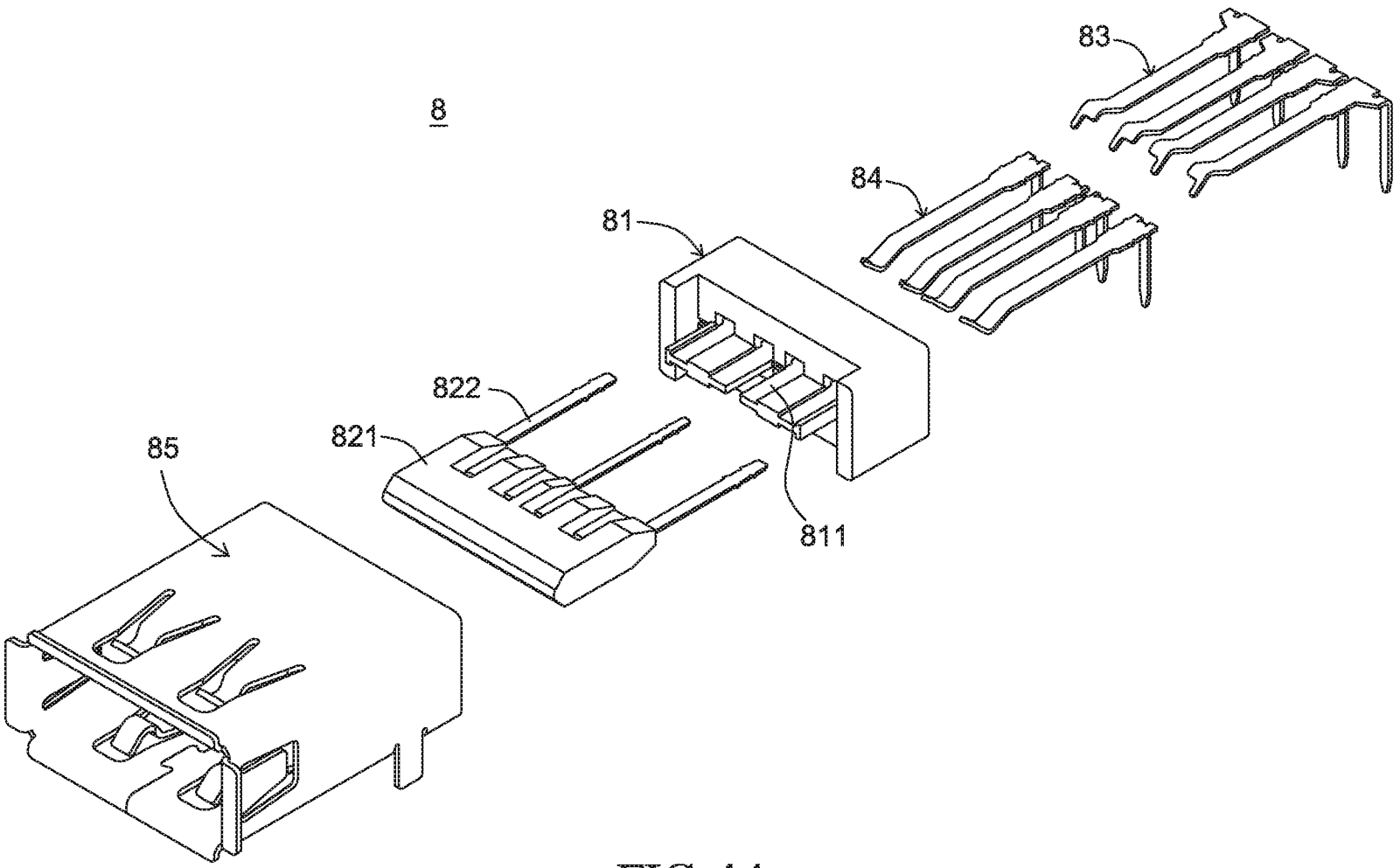
FIG. 44 is a decomposed schematic view showing a structure of the bidirectional double-sided electrical connector according to the sixth preferred embodiment the invention.

FIG. 44 is a decomposed schematic view showing the structure of the bidirectional double-sided electrical connector 8 according to the sixth embodiment of the invention. The assembling processes similar to FIGS. 22 and 23 are used to firstly assemble the plate body 821 with the resilient members 822 to form the assembly structure, and the insulation base seat 811 is combined into the insulation seat 81. The assembly structure including the resilient members 822 is then assembled with the insulation base seat 811, then the upper row of contact terminals 83 and the lower row of contact terminals 84 are assembled into the plate body 821 and the insulation base seat 111, and finally the outer housing 85 is fitted into the above-mentioned assembled body to form the bidirectional double-sided electrical connector 8.

Figure 45:
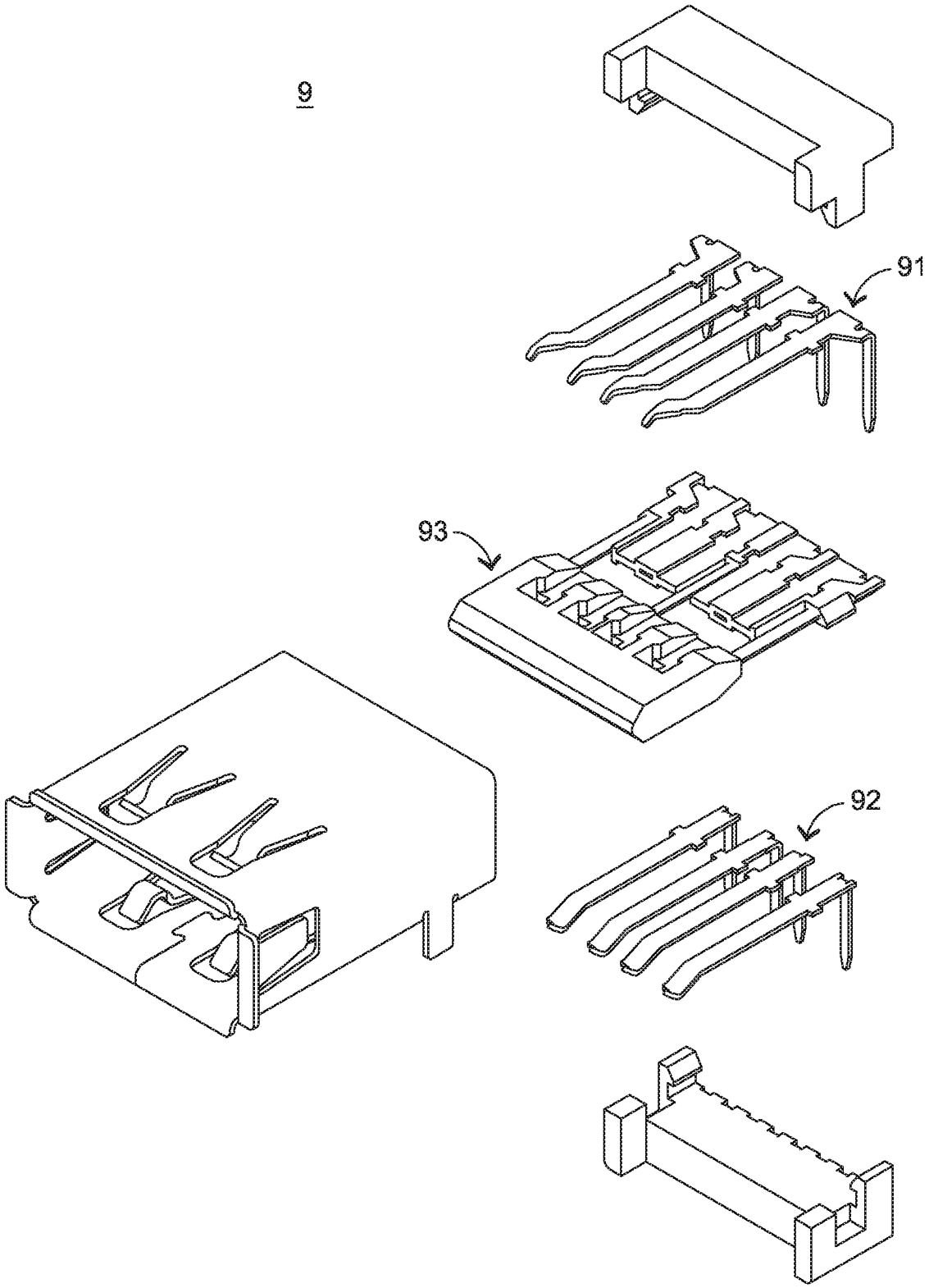
FIG. 45 is a decomposed schematic view showing a structure of the bidirectional double-sided electrical connector according to the seventh preferred embodiment of the invention.
Figure 48:
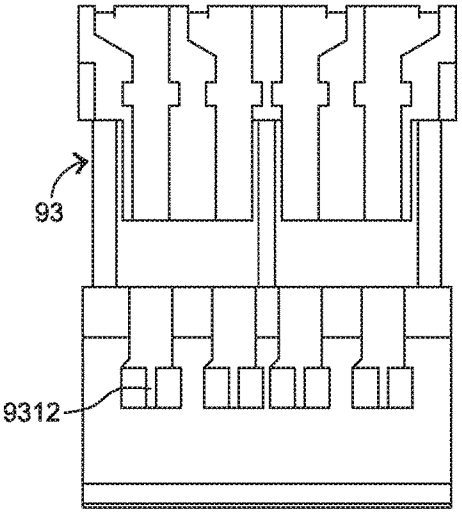
FIG. 48 is a schematic top view showing the tongue assembly structure of the bidirectional double-sided electrical connector according to the seventh preferred embodiment of the invention.
Figure 46:
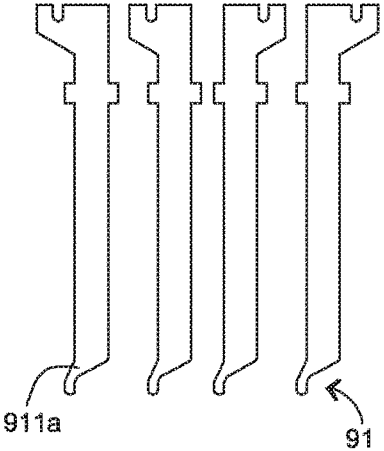
FIG. 46 is a schematic top view showing the upper row of contact terminals of the bidirectional double-sided electrical connector according to the seventh preferred embodiment of the invention.
Figure 47:
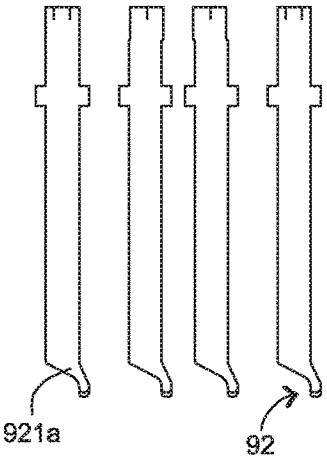
FIG. 47 is a schematic top view showing the lower row of contact terminals of the bidirectional double-sided electrical connector according to the seventh preferred embodiment of the invention.

FIG. 45 is a decomposed schematic view showing the structure of the bidirectional double-sided electrical connector 9 according to the seventh preferred embodiment of the invention. The schematic top views of the upper row of contact terminals 91, the lower row of contact terminals 92 and the tongue assembly structure 93 in the seventh preferred embodiment may refer to those shown in FIGS. 46 to 48. Referring to FIGS. 46 and 47, the upper bevel guide 911*a* of any one upper elastic movable connection point of the upper row of contact terminals 91 and the lower bevel guide 921*a* of the lower elastic movable connection point of any lower elastic movable connection point of the lower row of contact terminals 92 are staggered in a left-to-right direction, the arrangement structure of staggering in the left-right direction can prevent the upper row of contact terminals 91 and the lower row of contact terminals 92 from inadvertently touching and short circuiting. Next, each elastic-movement terminal slot may be provided with a separation column 9312, which can prevent the upper bevel guides 911*a* of the upper elastic movable connection points and the lower bevel guides 921*a* of the lower elastic movable connection points staggered in the left-to-right direction in this invention from contacting and short-circuiting. However, the invention needs not to collocate with the through slot with the separation column 9312, and the design without the separation column may also be adopted.

Figure 50:
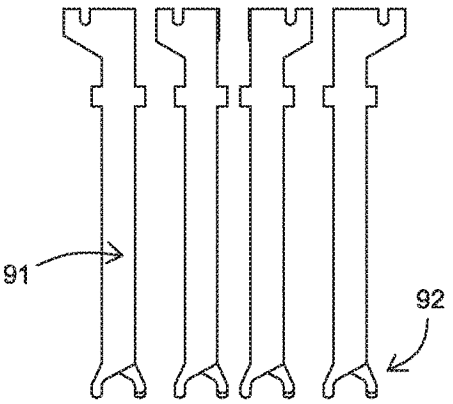
FIG. 50 is a schematic top view showing the upper row of contact terminals and the lower row of contact terminals of the bidirectional double-sided electrical connector according to the seventh preferred embodiment of the invention stacked into one part.
Figure 51:
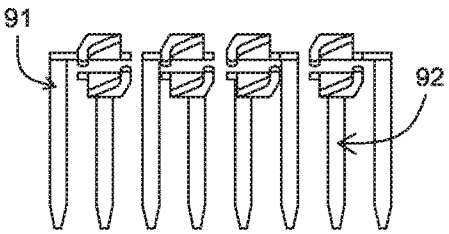
FIG. 51 is a schematic front view showing the upper row of contact terminals and the lower row of contact terminals of the bidirectional double-sided electrical connector according to the seventh preferred embodiment of the invention stacked into one part.
Figure 49:
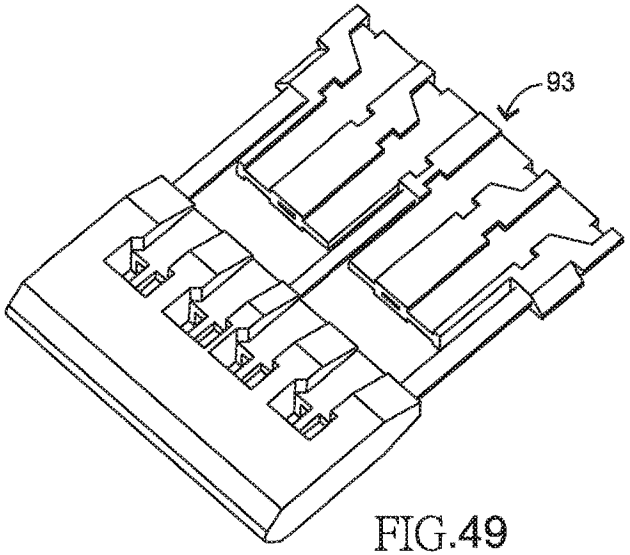
FIG. 49 is another schematic top view showing the tongue assembly structure of the bidirectional double-sided electrical connector according to the seventh preferred embodiment of the invention.

FIG. 49 is a schematic view showing the tongue assembly structure 93 at another stereoscopic viewing angle. Furthermore, FIG. 50 is a schematic top view showing that the upper row of contact terminals 91 and the lower row of contact terminals 92 are stacked into one part in the seventh preferred embodiment. FIG. 51 is a schematic front view showing that the upper row of contact terminals 91 and the lower row of contact terminals 92 are stacked into one part in the seventh preferred embodiment.

Figure 52:
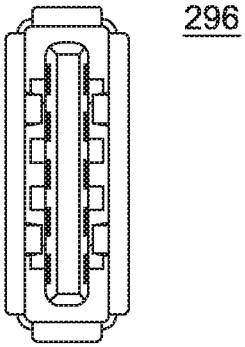
FIG. 52 is one of different perspectives showing the adapter connector of the invention having the bidirectional double-sided electrical connector.
Figure 53:
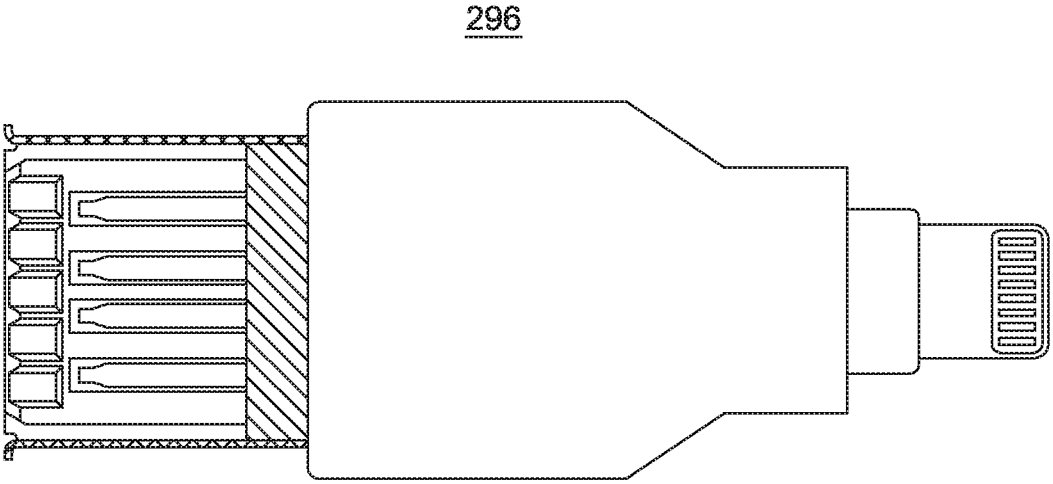
FIG. 53 is one of different perspectives showing the adapter connector of the invention having the bidirectional double-sided electrical connector.

FIGS. 52 and 53 are different perspectives showing the adapter connector 296 having the bidirectional double-sided electrical connector In short, the bidirectional double-sided electrical connector implemented by the invention at least has the following structure characteristics. However, the invention is not restricted to the following structure characteristics, and any person skilled in the art may have any equivalent variation or design.

1. The offset floating tongue and the correspondingly positioned elastically movable connection point form the elastically movable connection point projecting beyond the elastically movable connection point of the surface of the floating tongue by the height difference.

2. The elastically movable connection points of the upper and lower rows of contact terminals are depressedly disposed the elastic movement regions of the elastically movable connection points of the top and bottom sides of the floating tongue.

3. The floating tongue has the thickness dimension being the specification of USB 2.0 A Type socket standard 1.84 mm±0.05 mm of the USB Association. The height and width of the connection slot of the bidirectional connector are the standard specification of the USB 2.0 A Type socket of USB Association 4. The elastically movable extensions of the two rows of contact terminals are provided with middle section support segments, or the front section of the insulation seat is provided with the middle-section support insulation slot structure of the elastically movable extension of the terminal.

5. The top and bottom sides of the floating tongue are provided with the elastic-movement terminal slots of the elastically movable connection points.

6. The floating tongue is provided with the insulation baffle between the upper and lower contact terminals. The upper and lower rows of elastically movable connection points are embedded into or lie on or depressedly disposed in the elastically-movable-connection-point movement region on the two sides of the floating tongue.

7. Each of top and bottom surfaces of the floating tongue is provided with four isometric elastic-movement terminal slots of the elastically movable connection points.

8. The elastic metal sheets of the floating tongue are disposed between the second and third contact terminals and outside the two side contact terminals, or the elastic metal sheets of the floating tongue are disposed at the middle of the tongue and two outer sides.

9. The pins of the upper and lower rows of contact terminals of the bidirectional connector are arranged in front and rear rows or one single row.

10. The distance between the front end of the floating tongue and the insertion port is greater than a standard specification of a USB 2.0 A Type socket of USB Association. That is, the length of the floating tongue is shorter than the Associations standard. That is, the floating tongue is contracted much more inwardly at the front end of the insertion port than the Association's standard 11. The floating tongue has the water drop type or the front section thicker than the rear section having the gradually reduced structure. That is, the rear section of the floating tongue is the taper type structure.

12. The top and bottom sides of the floating tongue are provided with the elastic-movement terminal slot of the elastically movable connection point, and a through slot and a separation column are provided in the elastic-movement terminal slot.

13. The upper and lower rows of contact interfaces overlap vertically. The two bevel guides of the top and bottom elastic movable connection points are staggered in a left-to-right direction, wherein the left and right staggered structures prevent the upper and lower terminals from inadvertently touching to get short-circuited.

14. The tongue and the connection points respectively act independently. The so-called "respectively act independently" refers that the fixing portion of the contact terminal is not fixed to the tongue, so it cannot act floatingly together with the tongue. Thus, the tongue and the connection point can respectively act independently.

What is claimed is:

1. A bidirectional double-sided electrical connector, comprising:

an outer housing;

an insulation seat;

a floating tongue, which is disposed on a front end of the insulation seat, is covered by the outer housing to form a connection slot in the outer housing, and is vertically movably disposed in a middle section of the connection slot in a floating manner so that an upper connection slot and a lower connection slot are formed, wherein the floating tongue comprises a plate body having a convex portion of a thicker front section and a rear section with a gradually reduced structure; and two connection interfaces respectively facing the upper and lower connection slots, wherein each of the two connection interfaces comprises multiple elastically movable connection points provided by one row of contact terminals, one of the contact terminals of at least one of the rows of contact terminals has one of the elastically movable connection points, an elastically movable extension, a fixing portion and a pin, the elastically movable connection point is disposed on a front end of the elastically movable extension, and the elastically movable extension and the pin are respectively disposed on a front end and a rear end of the fixing portion, and the pins extend out of the insulation seat, wherein the elastically movable connection points of the two rows of contact terminals respectively face each other vertically and respectively face the upper and lower connection slots, and are disposed in back of the convex portion.

2. The bidirectional double-sided electrical connector according to claim 1 being an electrical receptacle and satisfying one of (a) to (e):

(a) wherein the two connection interfaces satisfy USB A type 2.0 specification, USB A type 3.0 specification or USB A type 3.1 specification, one of the contact terminals of the two rows of contact terminals has the elastically movable connection point, the extension, the fixing portion and the pin, and the two rows of pins extend out of the insulation seat in an arrangement of one single row, staggered front and rear rows, or overlapped front and rear rows;

(b) wherein the multiple fixing portions are embedded into or assembled and positioned in the insulation seat;

(c) wherein a distance between a front end of the floating tongue and an insertion port of the connection slot is greater than a standard specification of a USB 2.0 A Type socket of USB Association;

(d) wherein the two rows of contact terminals are reversely arranged according to circuit serial numbers, and the circuit serial numbers comprise power, signal D+, signal D− and ground; and (e) wherein the electrical receptacle further comprises two rows of flat contact terminals disposed on the top and bottom sides of the floating tongue and satisfying USB A type 3.0 specification or USB A type 3.1 specification, wherein the two connection interfaces satisfy USB A type 2.0 specification, multiple fixed connection points of the two rows of flat contact terminals are fixed to and exposed from top and bottom surfaces of the floating tongue, the two rows of flat contact terminals are connected to the floating tongue and the insulation seat, the floating tongue and the insulation seat are separated from each other, and extensions of the two rows of flat contact terminals disposed between the floating tongue and the insulation seat are elastically movable extensions.

3. The bidirectional double-sided electrical connector according to claim 1 satisfying one of (a) to (u):

(a) the two rows of elastically movable connection points are the same and aligned elastically movable contact interfaces;

(b) the elastically movable connection points on the top and bottom sides of the floating tongue are floatingly disposed or lie on or depressedly disposed on the floating tongue;

(c) the fixing portions of the at least one row of contact terminals are embedded or assembled and positioned with the insulation seat;

(d) the bidirectional double-sided electrical connector is an electrical plug, which further comprises two rows of flat contact terminals disposed on the top and bottom sides of the floating tongue and satisfying USB A type 3.0 specification or USB A type 3.1 specification, wherein the two connection interfaces satisfy USB A type 2.0 specification, the two rows of flat contact terminals are connected to the floating tongue and the insulation seat, the floating tongue and the insulation seat are separated from each other, and extensions of the two rows of flat contact terminals disposed between the floating tongue and the insulation seat are elastically movable extensions;

(e) the bidirectional double-sided electrical connector further comprises a docking electrical connector, wherein the docking electrical connector is provided with a connection plate, at least one surface of the connection plate is provided with at least one row of contact terminal connection interfaces, and when the one docking electrical connector is docked and inserted, the connection plate of the docking electrical connector pushes the floating tongue floatingly disposed in the middle section of the connection slot to offset vertically, so that the elastically movable connection point floatingly disposed on one of the top and bottom sides of the floating tongue is exposed and projects from the relatively offset one surface of the floating tongue to present a projecting height difference of the elastically movable connection point, and the projecting elastically movable connection points resilience rest against and are electrically connected to the docking inserted connection interface;

(f) the bidirectional double-sided electrical connector further comprises a docking electrical connector, wherein the docking electrical connector is provided with a connection plate, at least one surface of the connection plate is provided with at least one row of contact terminal connection interfaces, and when the one docking electrical connector is docked and inserted, the connection plate of the docking electrical connector pushes the floating tongue floatingly disposed in the middle section of the connection slot to offset vertically, so that the elastically movable connection point floatingly disposed on one of the top and bottom sides of the floating tongue is depressed in the relatively offset one surface of the floating tongue to present a depressed height difference of the elastically movable connection point, and a metal shell of a connection slot of the docking electrical connector and the elastically movable connection point depressed from one surface of the floating tongue hold a safety clearance without contacting each other;

(g) the floating tongue is provided with multiple elastic-movement terminal slots, each of the elastic-movement terminal slots corresponds to one of upper contact terminals and one of lower contact terminals, the elastic-movement terminal slot partially stores the corresponding upper contact terminal and lower contact terminal therein, and the upper contact terminals and the lower contact terminals are restricted to swing only in a vertical direction;

(h) a hollow region is provided, wherein the hollow region is disposed between the floating tongue and the insulation seat, the floating tongue and the insulation seat are detachable from each other, and the hollow region is provided with multiple metal elastic sheets connecting the floating tongue to the insulation seat;

(i) the elastically movable connection points of the two rows of contact terminals respectively face each other vertically and respectively face the upper and lower connection slots, and are disposed in back of the convex portion;

(j) the elastically movable connection points of the two rows of contact terminals respectively face each other, and the elastically movable connection points are depressedly disposed on a most convex surface of the top plate surface and a most convex surface of the bottom plate surface of the floating tongue (k) two sides of the floating tongue are provided with top and bottom elastic movable connection points relatively overlapped, two bevel guides of the top and bottom elastic movable connection points are staggered in a left-to-right direction to present left and right staggered structures;

(l) two bevel guides of the top and bottom elastic movable connection points are staggered in a left-right direction, and elastic movement regions of the floating tongue on two bevel guides of the top and bottom elastic movable connection points are provided with multiple through slots or multiple partition plate structures;

(m) the elastically movable connection points of the two rows of contact terminals respectively face each other vertically and have a vertically overlapped positional relationship, and the two bevel guides of the two elastically movable connection points with the vertically overlapped positional relationship are equidistant from an insertion port of the connection slot;

(n) top and bottom surfaces of the floating tongue are provided with water-drop arrow type anti-short-circuit insulation structures;

(o) the bidirectional double-sided connector is an A TYPE USB 2.0/3.0/3.1 contact interface socket;

(p) each of the two rows of contact terminals contains four contact terminals, which are respectively a power terminal, a signal D+ terminal, a signal D− terminal and a ground terminal, and the bidirectional double-sided electrical connector further comprises two rows of flat contact terminals provided on the top and bottom plate surfaces of the floating tongue and satisfying USB A type 3.0 specification or USB A type 3.1 specification, wherein multiple fixed connection points of the two rows of flat contact terminals are fixed and exposed from top and bottom surfaces of the floating tongue, each of the two rows of flat contact terminals contains five flat contact terminals, and each of the rows of flat contact terminals has a middle ground terminal and two pairs of signal terminals on two sides, wherein the two rows of elastically movable connection points are disposed in back of the two rows of fixed connection points, wherein the two pairs of signal terminals on two side of the upper and lower rows of flat contact terminals are turned and adjacently embedded with a transversal separation column structure between the one row of fixed connection points of the floating tongue and the one row of elastically movable connection points;

(q) the bidirectional double-sided electrical connection plug or socket may be applied to an adapter device including a HUB expander, power bank/charger/mobile power, or mobile disk/U disk/thumb disk/mobile hard disk, or other electronic device;

(r) the bidirectional double-sided electrical connector further comprises two rows of flat contact terminals, which are disposed on the top and bottom plate surfaces of the floating tongue and satisfy USB A type 3.0 specification or USB A type 3.1 specification, wherein multiple fixed connection points of the two rows of flat contact terminals are fixed and exposed from top and bottom surfaces of the floating tongue, each of the two rows of fixed connection points has five fixed connection points that are respectively RX+, RX−, GND, TX+ and TX−, each of the two rows of elastically movable connection points has five elastically movable connection points that are respectively power, signal D+, signal D− and ground, and the one row of elastically movable connection points are disposed in back of the one row of fixed connection points to form a USB 3.0/3.1 contact interface;

(s) each of the two rows of contact terminals contains four contact terminals, which are respectively a power terminal, a signal D+ terminal, a signal D− terminal and a ground terminal, and the bidirectional double-sided electrical connector further comprises two rows of flat contact terminals provided on the top and bottom plate surfaces of the floating tongue and satisfying USB A type 3.0 specification or USB A type 3.1 specification, wherein multiple fixed connection points of the two rows of flat contact terminals are fixed and exposed from top and bottom surfaces of the floating tongue, each of the two rows of flat contact terminals contains five flat contact terminals, and each of the rows of flat contact terminals has a middle ground terminal and two pairs of signal terminals on two sides, wherein the two rows of elastically movable connection points are disposed in back of the two rows of fixed connection points, wherein the two rows of flat contact terminals and the floating tongue are injection molded and embedded, and a transversal separation column structure is provided between the one row of fixed connection points and the one row of elastically movable connection points of the top and bottom plate surfaces of the floating tongue;

(t) upper and lower rows of flat-contacting contact terminals of front and rear sides of the floating tongue and the insulation tongue are one-time embedded together, and two side signal terminals of the top and bottom surfaces flat-contacting contact terminal are turned and adjacently embedded together at the floating tongue; and (u) the bidirectional double-sided electrical receptacle may be horizontal, side-standing, vertical, multilayer or a structure composed of different connection interfaces stacked together, and may be two rows or only one row of horizontal pins or in front and rear rows, wherein the front row is horizontal insert pins and the rear row is longitudinal insert pins.

4. The bidirectional double-sided electrical connector according to claim 1, wherein the floating tongue and the elastically movable connection points respectively act independently.

5. The bidirectional double-sided electrical connector according to claim 1, wherein a front edge of the insulation seat is provided with at least one middle-section support structure, the middle-section support structure and one of the elastically movable extensions have a vertically overlapped positional relationship, or one of the elastically movable extensions has a middle section support segment exposed outside the insulation seat, or one of the elastically movable extensions has a middle section support segment exposed outside the insulation seat and has a vertically overlapped positional relationship together with a middle-section support structure of a front edge of the insulation seat.

* * * * *